US012575643B2

(12) United States Patent
Maselino

(10) Patent No.: US 12,575,643 B2
(45) Date of Patent: Mar. 17, 2026

(54) SOLE STRUCTURES AND ARTICLES OF FOOTWEAR HAVING SEPARATE AND SEPARABLE OUTSOLE AND MIDSOLE COMPONENTS

(71) Applicant: NIKE, Inc., Beaverton, OR (US)

(72) Inventor: Gabriel T. Maselino, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 11 days.

(21) Appl. No.: 17/743,856

(22) Filed: May 13, 2022

(65) Prior Publication Data

US 2022/0361632 A1 Nov. 17, 2022

Related U.S. Application Data

(60) Provisional application No. 63/188,070, filed on May 13, 2021.

(51) Int. Cl.

| | |
|---|---|
| ***A43B 13/36*** | (2006.01) |
| ***A43B 13/14*** | (2006.01) |
| ***A43B 13/22*** | (2006.01) |

(52) U.S. Cl.

CPC ..... *A43B 13/36* (2013.01); *A43B 13/141* (2013.01); *A43B 13/223* (2013.01)

(58) Field of Classification Search

CPC ..... A43B 13/141; A43B 13/36; A43B 13/223; A43B 5/00

See application file for complete search history.

(56) References Cited

U.S. PATENT DOCUMENTS 997,657 A * 7/1911 Drake ..... A43B 13/125 36/129
2,552,943 A * 5/1951 Danielius ..... A43B 3/24 36/15

(Continued)

FOREIGN PATENT DOCUMENTS

CN 201294914 Y 8/2009
KR 200346303 Y1 3/2004

(Continued)

OTHER PUBLICATIONS

Aug. 23, 2022—(WO) ISR & WO—App. No. PCT/US22/072308.

(Continued)

*Primary Examiner* — Heather Mangine
*Assistant Examiner* — Raquel M. Weis
(74) *Attorney, Agent, or Firm* — Banner & Witcoff, Ltd.

(57) ABSTRACT

Footwear and/or sole structures may include any one or more of: (a) a midsole component having one or more relatively large projections that extend into one or more corresponding openings in a midsole component (wherein the free end surface(s) of the large projection(s) may be siped); (b) a midsole component having one or more relatively small protrusions that extend into one or more small corresponding holes in an outsole component; (c) a midsole component having one or more relatively small holes into which one or more small corresponding protrusions on the outsole component extend; (d) a midsole component having medial and/or lateral side ridges (e.g., at least in an arch area) that receive a portion of outermost side edges of a corresponding outsole component; and/or (e) a midsole component having a relatively large central arch recess exposed through an opening in the outsole component.

22 Claims, 24 Drawing Sheets

(56) References Cited

U.S. PATENT DOCUMENTS 3,538,628 A * 11/1970 Einstein, Jr. ..... A43B 3/0078 36/15
3,890,725 A * 6/1975 Lea ..... A43B 3/244 36/11.5
3,902,259 A * 9/1975 Cracco ..... A43B 3/24 36/11.5
4,317,294 A * 3/1982 Goodyear ..... A43B 13/36 36/36 B
4,377,042 A * 3/1983 Bauer ..... A43B 13/36 36/15
4,420,894 A * 12/1983 Glassman ..... A43B 13/36 36/12
5,315,767 A 5/1994 Bradbury
5,317,822 A * 6/1994 Johnson ..... A43B 13/36 36/15
5,367,791 A * 11/1994 Gross ..... A43B 13/26 36/31
5,644,857 A * 7/1997 Ouellette ..... A43B 3/24 36/15
6,023,857 A * 2/2000 Vizy ..... A43B 13/36 36/28
6,023,859 A * 2/2000 Burke ..... A43B 13/36 36/105
6,032,386 A * 3/2000 Evans ..... A43B 5/185 36/15
6,138,386 A * 10/2000 Singer ..... A43C 15/16 36/134
6,813,847 B2 * 11/2004 Workman ..... A43B 5/18 36/15
6,931,766 B2 * 8/2005 Greene ..... A43B 3/122 36/15
7,076,890 B2 * 7/2006 Grove ..... A43B 7/1445 36/15
7,140,129 B2 * 11/2006 Newson ..... A43B 3/244 36/3 R
7,451,557 B2 * 11/2008 McDonald ..... A43B 3/246 36/105
7,520,069 B2 * 4/2009 Workman ..... A43B 5/08 36/15
7,543,399 B2 * 6/2009 Kilgore ..... A43B 13/36 36/15
7,549,237 B2 * 6/2009 Gallegos ..... A43B 13/18 36/15
7,578,076 B2 * 8/2009 Pawlus ..... A43B 19/00 36/15
7,644,517 B2 * 1/2010 Gerber ..... A43B 3/103 36/11.5
7,721,466 B2 * 5/2010 Guo ..... A43B 17/08 36/43
7,793,429 B2 * 9/2010 Ellis ..... A43B 13/187 36/25 R
7,836,610 B2 * 11/2010 Laporte ..... A43C 15/08 36/62
7,874,083 B1 * 1/2011 Tillman ..... A43B 13/36 36/73
8,006,408 B2 * 8/2011 Leedy ..... A43B 21/36 36/15
8,205,357 B2 * 6/2012 Keating ..... A43B 13/125 36/141
8,356,426 B1 * 1/2013 Daniel ..... A43B 13/16 36/15
8,474,155 B2 * 7/2013 McDonald ..... A43B 13/223 36/102
8,544,189 B2 * 10/2013 Chaney ..... A43B 13/24 36/15
8,789,253 B2 7/2014 Kilgore et al.
9,408,434 B2 * 8/2016 Su ..... A43B 7/087
9,907,355 B2 * 3/2018 Barnes ..... A43B 3/246
9,955,748 B2 * 5/2018 Grove ..... A43B 13/36
10,531,700 B2 * 1/2020 Johnson ..... A43B 13/36
10,588,379 B2 * 3/2020 Sussmann ..... A43B 3/0047
10,653,206 B2 * 5/2020 Chaney ..... A43B 13/04
10,681,955 B2 * 6/2020 Beers ..... A43B 13/36
10,959,490 B1 * 3/2021 Gomez ..... A43B 13/30
2002/0178613 A1 * 12/2002 Williamson ..... A43B 13/36 36/15
2002/0178620 A1 * 12/2002 Asciolla ..... A43B 13/36 36/15
2004/0088883 A1 * 5/2004 Workman ..... A43B 3/18 36/62
2004/0148803 A1 * 8/2004 Grove ..... A43B 23/0245 36/31
2005/0268491 A1 * 12/2005 McDonald ..... A43B 9/00 36/28
2006/0021260 A1 * 2/2006 Kim ..... A43B 21/39 36/130
2006/0042119 A1 * 3/2006 Workman ..... A43B 5/08 36/15
2007/0289161 A1 * 12/2007 Gerber ..... A43B 3/0047 36/12
2008/0222920 A1 * 9/2008 Rovida ..... A43B 3/0047 36/62
2008/0235986 A1 * 10/2008 Guo ..... A43B 17/08 36/30 R
2008/0289222 A1 * 11/2008 Candrian ..... A43C 11/14 36/15
2009/0126230 A1 * 5/2009 McDonald ..... A43B 13/12 36/103
2009/0293309 A1 * 12/2009 Keating ..... A43B 13/12 36/114
2011/0035963 A1 * 2/2011 Baker ..... A43B 13/40 36/114
2012/0210606 A1 * 8/2012 Gheorghian ..... A43B 13/127 36/103
2012/0227289 A1 * 9/2012 Beers ..... A43B 3/246 12/146 B
2013/0067765 A1 * 3/2013 Auger ..... A43B 23/22 36/31
2013/0125421 A1 5/2013 Stegmaier et al.
2014/0041257 A1 * 2/2014 Robinson ..... A43B 3/244 36/100
2014/0259779 A1 * 9/2014 Hashish ..... A43B 7/1445 12/142 R
2015/0020414 A1 * 1/2015 Mulholland ..... A43B 1/0081 36/100
2015/0320142 A1 * 11/2015 Handelman ..... A43B 5/18 36/15
2016/0324264 A1 * 11/2016 Johnson ..... A43B 3/244
2016/0331064 A1 * 11/2016 Kawakami ..... A43B 23/0245
2016/0360822 A1 * 12/2016 Park ..... A43B 13/34
2017/0231316 A1 * 8/2017 Sethi ..... A43B 13/36 36/97
2019/0008232 A1 * 1/2019 Chaney ..... A43B 13/04
2019/0116925 A1 * 4/2019 Darby ..... A43B 7/1405
2019/0223554 A1 * 7/2019 Osborn ..... A43B 3/246
2019/0297989 A1 * 10/2019 ADAMSOn ..... A43B 13/122
2019/0328082 A1 * 10/2019 Del Biondi ..... A43B 13/14
2020/0068989 A1 * 3/2020 Lubart ..... A43B 13/223
2020/0085135 A1 * 3/2020 Johnson ..... A43B 9/00
2020/0268099 A1 * 8/2020 Lewis ..... A43B 7/1405
2021/0227929 A1 * 7/2021 Ni ..... A43B 13/37
2021/0368918 A1 * 12/2021 Lyke ..... A43B 13/223
2022/0104584 A1 * 4/2022 Bazan ..... A43B 3/244
2022/0304418 A1 * 9/2022 Kaila ..... A43B 3/244
2022/0361632 A1 * 11/2022 Maselino ..... A43B 13/141
2023/0157412 A1 * 5/2023 Sussmann ..... A43B 13/36 36/25 R

FOREIGN PATENT DOCUMENTS

KR 101434516 B1 8/2014
KR 200488871 Y1 7/2019
WO 2010093271 A1 8/2010
WO 2011067489 A1 6/2011

(56) References Cited

FOREIGN PATENT DOCUMENTS

| | | | |
|---|---|---|---|
| WO | 2011080779 | A1 | 7/2011 |
| WO | 2013038034 | A1 | 3/2013 |

OTHER PUBLICATIONS

Edgar, "Running Shoe with Interchangeable Soles," Apr. 29, 2016, 2 pages.
Korkers Website listing of "Greenback™, " Wayback Machine, Jun. 9, 2020, 2 pages.
Website Listing of "Shooz: The World's First Modular-Tech Travel Shoe," Oct. 27, 2020, 1 page.
"Solay Running Shoe Concept from Continuum," The Wayback Machine, <<https://web.archive.org/web/20080626103600/http://www.tuvie.com:80/solay-runnin...>>, date of publication unknown but believed to be prior to Jun. 26, 2008, 9 pages.
"SwapSOLE, The Concept," Wayback Machine, <<https://www.herts.ac.uk/digitalhacklab/projects/swapsole>>, May 19, 2017, 2 pages.
Website Printout of "Korkers Greenback Wading Boot," <<https://flymasters.com/shop/wading-boots-shoes/>>, Apr. 5, 2021, 5 pages.
Aug. 19, 2025 (EP) Communication with European Search Report—App. EP25166044, 9 pages.

* cited by examiner

SOLE STRUCTURES AND ARTICLES OF FOOTWEAR HAVING SEPARATE AND SEPARABLE OUTSOLE AND MIDSOLE COMPONENTS

RELATED APPLICATION DATA

This application is a U.S. Non-Provisional Patent Application of and claims priority to U.S. Provisional Patent Appln. No. 63/188,070, filed May 13, 2021 and entitled "Sole Structures and Articles of Footwear Having Separate Outsole and Midsole Components." U.S. Provisional Patent Appln. No. 63/188,070 is entirely incorporated herein by reference.

FIELD OF THE INVENTION

Aspects of the present invention relate to articles of footwear and sole structures for articles of footwear that include separate outsole and midsole components. In some examples of this technology, at least some of the footwear and/or sole structure components may be removable (and interchangeable), e.g., one or more outsole components removably engaged with one or more midsole components and/or one or more sole structure components removably engaged with one or more footwear upper components.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

SUMMARY OF THE INVENTION

Footwear and sole structures may include separate and/or separable upper, outsole, and/or midsole components. In some examples, at least some of the footwear and/or sole structure components may be removable (and interchangeable), e.g., one or more outsole components that are removably engaged with one or more midsole components and/or one or more sole structure components that are removably engaged with one or more footwear upper components.

Footwear and/or sole structures according to some examples of this technology may include any one or more of: (a) a midsole component having one or more relatively large projections that extend into corresponding opening(s) in a midsole component (wherein the free end surface(s) of the large projection(s) may be siped); (b) a midsole component having one or more relatively small protrusions that extend into small corresponding hole(s) in an outsole component; (c) a midsole component having one or more relatively small holes into which small corresponding protrusion(s) on the outsole component extend; (d) a midsole component having medial and/or lateral side ridges (e.g., at least in an arch area) that receive a portion of outermost side edges of a corresponding outsole component; and/or (e) a midsole component having a relatively large central arch recess exposed through an opening in the outsole component.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1A:
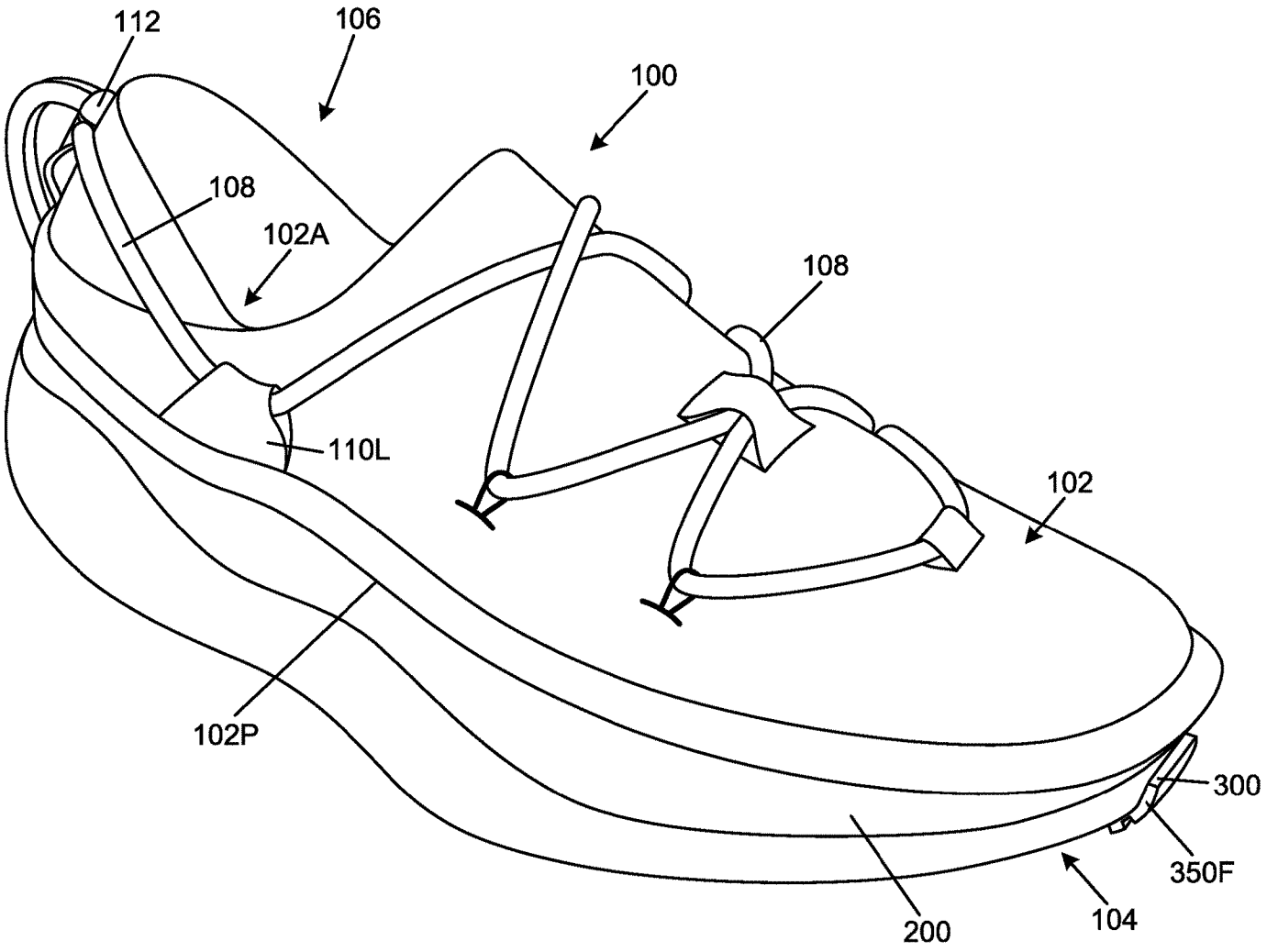
FIGS. 1A-1D provide various views of an article of footwear in accordance with some examples of this technology.

In the following description of various examples of footwear structures and components according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described and illustrated structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, urban dance shoes, etc.), and the like.

The term "adjacent" as used herein (unless otherwise noted or clear from the context) means one object (e.g., a hole or other sole element or component) is next to, nearby, and/or close to another object (e.g., a central arch recess or other sole element or component). In some examples of this technology, the term "adjacent" will mean that at least some portion of one object (e.g., a hole or other sole element or component) is located within 15 mm from at least some portion of the other object (e.g., a central arch recess or other sole element or component), and in some examples, at least some portions of the relevant objects will be within 10 mm or even within 8 mm of one another. The term "immediately adjacent" means two objects (e.g., (a) an outsole component and/or a hole defined through the outsole component and (b) a free end surface of a projection received in the outsole component hole) are abutting or located continuous with one another. "Adjacent" or "immediately adjacent" objects may contact or abut one another.

The terms "removably engaged" or "removably attached" as used herein (unless otherwise noted or clear from the context) mean that the two "engaged" or "attached" objects are designed to be repeatedly "engaged/disengaged" and/or "attached/unattached" to one another without damaging either object or structures with which those objects are engaged. In other words, the terms "removably engaged" and/or "removably attached" mean that the two "engaged" or "attached" objects are "non-destructibly removable" and/or releasable from one another.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure or structures. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

Various structures and parameters of articles of footwear and sole structures therefor are described based on a "longitudinal length" parameter L. The longitudinal length L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP that are perpendicular to the horizontal support surface S are oriented to contact the rearmost heel (RH) location(s) and forwardmost toe (FT) location(s) of the article of footwear and/or sole structure. The parallel vertical planes VP should be oriented facing one another, e.g., extending into and out of the page of FIG. 1C, and as far away from one another as possible while still in contact with the rearmost heel RH and forwardmost toe FT locations. The direct distance between these vertical planes VPs corresponds to the longitudinal length L of the article of footwear and/or sole structure. The locations of some footwear components are described in this specification based on their respective locations along the longitudinal length L as measured forward from the rear heel vertical plane VP. The rearmost heel location(s) is (are) located at position 0L and the forwardmost toe location(s) is (are) located at position 1L along the longitudinal length L. Intermediate locations along the longitudinal length L are referred to by fractional locations (e.g., 0.25L) along the longitudinal length L measured forward from the rear heel vertical plane VP. The term "parallel planes" as used herein are planes oriented parallel to the vertical planes VP. These parallel planes may intersect the longitudinal length or longitudinal direction somewhere between P=0L and P=1.0L. Note FIG. 1C.

I. General Description of Aspects of this Technology

As noted above, articles of footwear and sole structures in accordance with some aspects of this technology include removable (and interchangeable) sole structure components (e.g., one or more outsole components that are removably engaged with one or more midsole components and/or one or more sole structure components that are removably engaged with one or more footwear upper components).

At least some more specific aspects of this technology relate to sole structures and/or articles of footwear that include: (a) a midsole component having a bottom surface, wherein the bottom surface includes: (i) a base surface and (ii) a first projection including a first body extending away from the base surface (wherein a first exposed free end surface of the first projection may include a first pair of intersecting sipes extending inward into the first body); and (b) an outsole component removably engaged with the midsole component. The outsole component includes a first hole defined therein, and the first projection extends into the first hole. The first exposed free end surface of the first projection is exposed through the first hole and recessed inward from an exposed exterior surface of the outsole component located immediately adjacent the first hole. Sole structures and/or articles of footwear according to aspects of this technology may include one or more mating pair of midsole projection(s) and outsole component hole(s) of this type. Such mating pair of midsole projection(s) and outsole component hole(s) may be located in a sole structure and/or article of footwear structure at one or more of the following locations: (a) between parallel planes (as described above) located at 0.65L and 0.98L, and in some examples between parallel planes located at 0.7L and 0.96L or between parallel planes located at 0.72L and 0.94L; (b) between parallel planes located at 0.45L and 0.85L, and in some examples between parallel planes located at 0.5L and 0.8L or between parallel places located at 0.52L and 0.77L; and/or (c) between parallel planes located at 0.02L and 0.45L, and in some examples between parallel planes located at 0.04L and 0.4L or between parallel planes located at 0.06L and 0.32L. Additionally, in some examples of this technology, a projection/hole pair of this type may span at least 50% (and in some examples, at least 60%, at least 75%, or even at least 90%) of the distance between the parallel planes for any one or more of the parallel plane ranges described above. Additionally or alternatively, in some examples of this technology at least 50% of the surface area and/or volume of the projection/hole pair(s) (and in some examples, at least 60%, at least 75%, or even at least 90% of the surface area and/or volume) will be located between any one or more of the parallel plane ranges described above. Such sole structures and/or articles of footwear may include multiple projection and hole pairs of this type (e.g., up to 12 projection/hole pairs, up to 10 projection/hole pairs, up to 8 projection/hole pairs, etc.).

Some additional or alternative aspects of this technology relate to sole structures and/or articles of footwear that include: (a) a midsole component having a bottom surface, wherein the bottom surface includes: (i) a base surface, (ii) a lateral side ridge extending away from (e.g., downward from) the base surface, wherein a lateral side portion of the midsole component outside the lateral side ridge defines at least a portion of a lateral side bottom perimeter surface of the sole structure (a lateral side outermost exterior perimeter of the sole structure), and (iii) a medial side ridge extending away from (e.g., downward from) the base surface, wherein a medial side portion of the midsole component outside the medial side ridge defines at least a portion of a medial side bottom perimeter surface of the sole structure (a medial side outermost exterior perimeter of the sole structure); and (b) an outsole component removably engaged with the midsole component, wherein at least a portion of an outermost exterior lateral edge of the outsole component is located inside the lateral side ridge, and wherein at least a portion of an outermost exterior medial edge of the outsole component is located inside the medial side ridge.

Still additional or alternative aspects of this technology relate to sole structures and/or articles of footwear that include: (a) a midsole component having a bottom surface, wherein the bottom surface includes: (i) a base surface, (ii) a first protrusion extending outward from the base surface, wherein the first protrusion has a transverse cross sectional area of less than 200 $mm^2$, and (iii) a first hole extending inward from the base surface, wherein the first hole defines a transverse cross sectional area of less than 200 $mm^2$; and (b) an outsole component removably engaged with the midsole component, wherein the outsole component includes: (i) an interior surface, (ii) a second protrusion extending from the interior surface (e.g., inwardly) and into the first hole of the midsole component, and (iii) a second hole defined in the interior surface and receiving the first protrusion of the midsole component. Each of the midsole component and the outsole component may have multiple protrusions and/or multiple holes such that the overall sole structure has plural projection/hole pairs engaged together.

Further additional or alternative aspects of this technology relate to sole structures and/or articles of footwear that include: (a) a midsole component having a bottom surface, wherein the bottom surface includes: (i) a base surface, (ii) a first hole extending inward from the base surface, wherein the first hole defines a transverse cross sectional area of less than 200 $mm^2$, and (iii) a second hole extending inward from the base surface, wherein the second hole defines a transverse cross sectional area of less than 200 $mm^2$; and (b) an outsole component removably engaged with the midsole component, wherein the outsole component includes: (i) an interior surface, (ii) a first protrusion extending from the interior surface (e.g., inwardly) and into the first hole of the midsole component, and (iii) a second protrusion extending from the interior surface (e.g., inwardly) and into the second hole of the midsole component. The midsole component may include one or more additional holes and/or one or more additional projections and the outsole component may include one or more additional mating projections and/or one or more additional holes.

Still further additional or alternative aspects of this technology relate to sole structures and/or articles of footwear that include: (a) a midsole component having a bottom surface, wherein the bottom surface includes: (i) a base surface, (ii) a first protrusion extending outward from the base surface, wherein the first protrusion has a transverse cross sectional area of less than 200 $mm^2$, (iii) a second protrusion extending outward from the base surface, wherein the second protrusion has a transverse cross sectional area of less than 200 $mm^2$, (iv) a first hole extending inward from the base surface, wherein the first hole defines a transverse cross sectional area of less than 200 $mm^2$, and (v) a second hole extending inward from the base surface, wherein the second hole defines a transverse cross sectional area of less than 200 $mm^2$; and (b) an outsole component removably engaged with the midsole component, wherein the outsole component includes: (i) an interior surface, (ii) a third protrusion extending from the interior surface (e.g., inwardly) and into the first hole of the midsole component, (iii) a fourth protrusion extending from the interior surface (e.g., inwardly) and into the second hole of the midsole component, (iv) a third hole defined in the interior surface and receiving the first protrusion of the midsole component, and (v) a fourth hole defined in the interior surface and receiving the second protrusion of the midsole component. Each of the midsole component and the outsole component may include one or more additional protrusions and/or one or more mating holes engaging the additional protrusion(s).

Additional or alternative aspects of this technology relate to sole structures and/or articles of footwear that include: (a) a midsole component having a bottom surface, wherein the bottom surface includes: (i) a base surface including a lateral side region and a medial side region, (ii) a central arch recess extending inward from the base surface and located between the lateral side region and the medial side region, and (iii) a first hole located adjacent the central arch recess and extending inward from the base surface at one of the lateral side region or the medial side region, wherein the first hole defines a transverse cross sectional area of less than 200 $mm^2$; and (b) an outsole component removably engaged with the midsole component, wherein the outsole component includes: (i) an interior surface, (ii) a first opening through which the central arch recess is exposed at a bottom of the sole structure, and (iii) a first protrusion extending from the interior surface and into the first hole of the midsole component. Such sole structures and/or articles of footwear may include one or more additional mating holes and protrusion pairs located in the lateral and/or medial ridge regions, e.g., up to 8 hole/protrusion pairs, up to 6 hole/protrusion pairs, or up to 4 hole/protrusion pairs.

In some examples of this technology, the midsole components and outsole components of any of the examples described above may be releasably engaged with one another (e.g., to permit interchanging parts, to facilitate recycling, etc.). Alternatively, some aspects of this technology relate to sole structures and/or articles of footwear of the types described above in which the midsole components and the outsole components according to any of the examples described above are permanently engaged with one another (e.g., by adhesives or cements, by mechanical fasteners, etc.).

Still additional aspects of this technology relate to methods of making sole structures and/or articles of footwear of the various types described above as well as to methods of using sole structures and/or articles of footwear of the types described above (e.g., by attaching and detaching the outsole component from the midsole component, by attaching and detaching the sole structure (or at least a portion thereof) from a footwear upper component, by interchanging different outsole components on a midsole component structure, by interchanging different midsole component structures on an outsole component, by interchanging different sole structures on an upper component, by interchanging different upper components on a sole structure, etc.).

Given the general description of features, examples, aspects, structures, processes, and arrangements according to certain examples of this technology provided above, a more detailed description of specific example sole structures, articles of footwear, and/or methods in accordance with this technology follows.

Figure 1B:
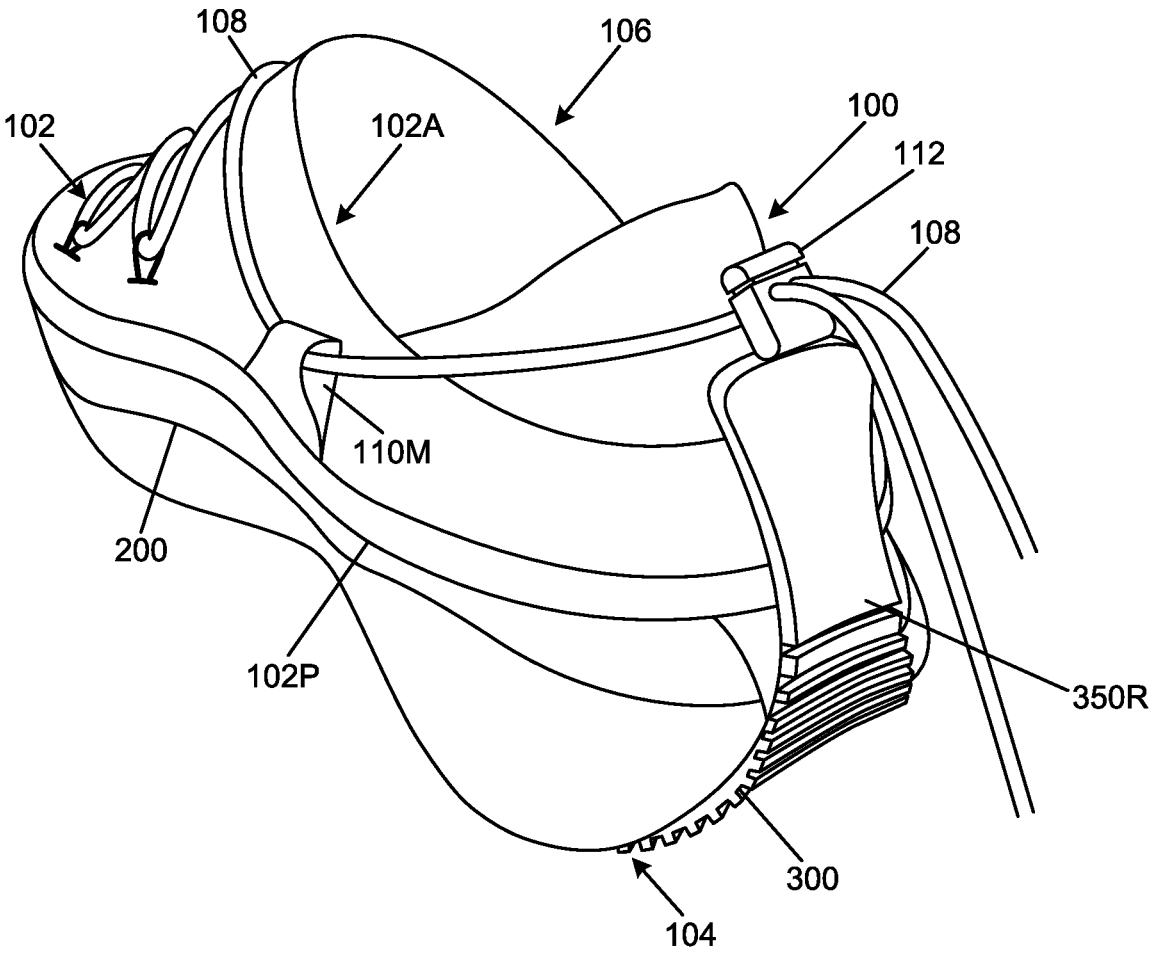
Figure 1C:
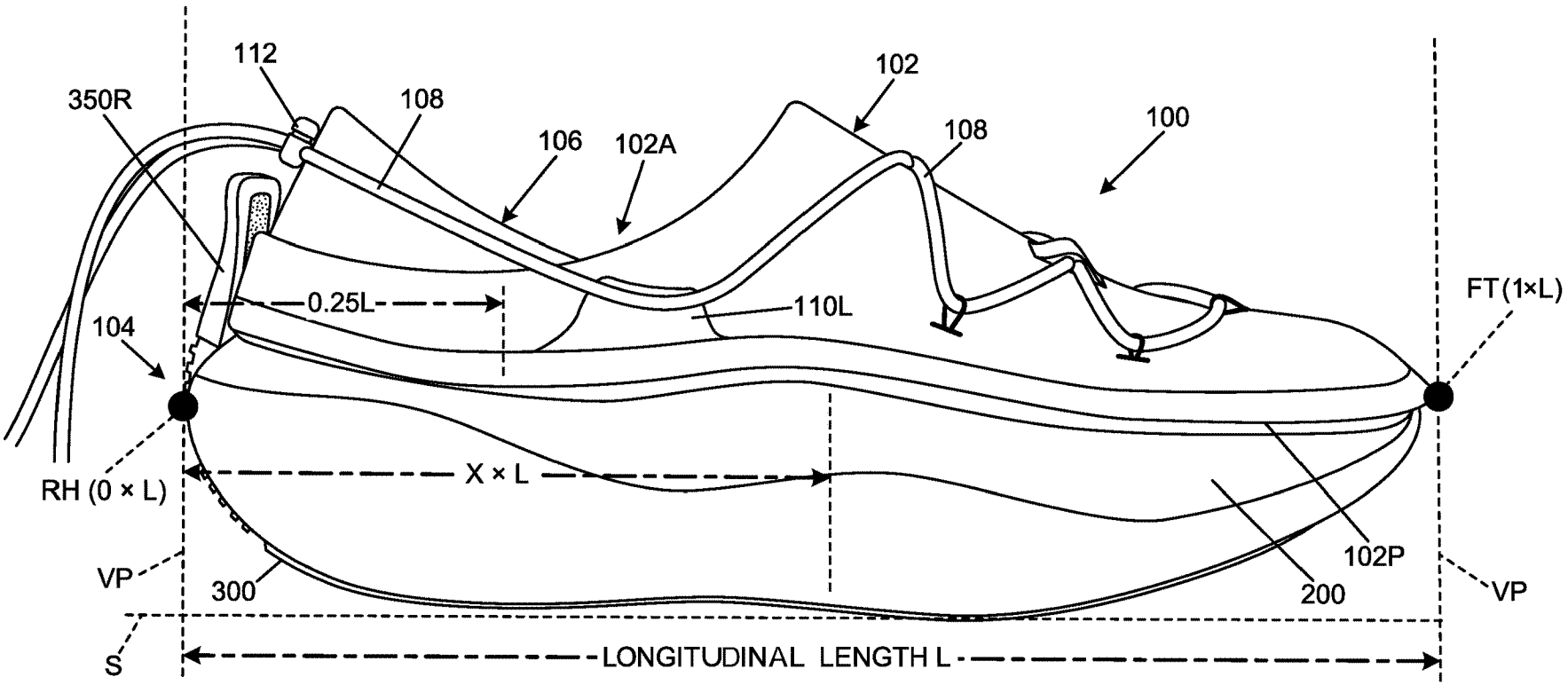
Figure 1D:
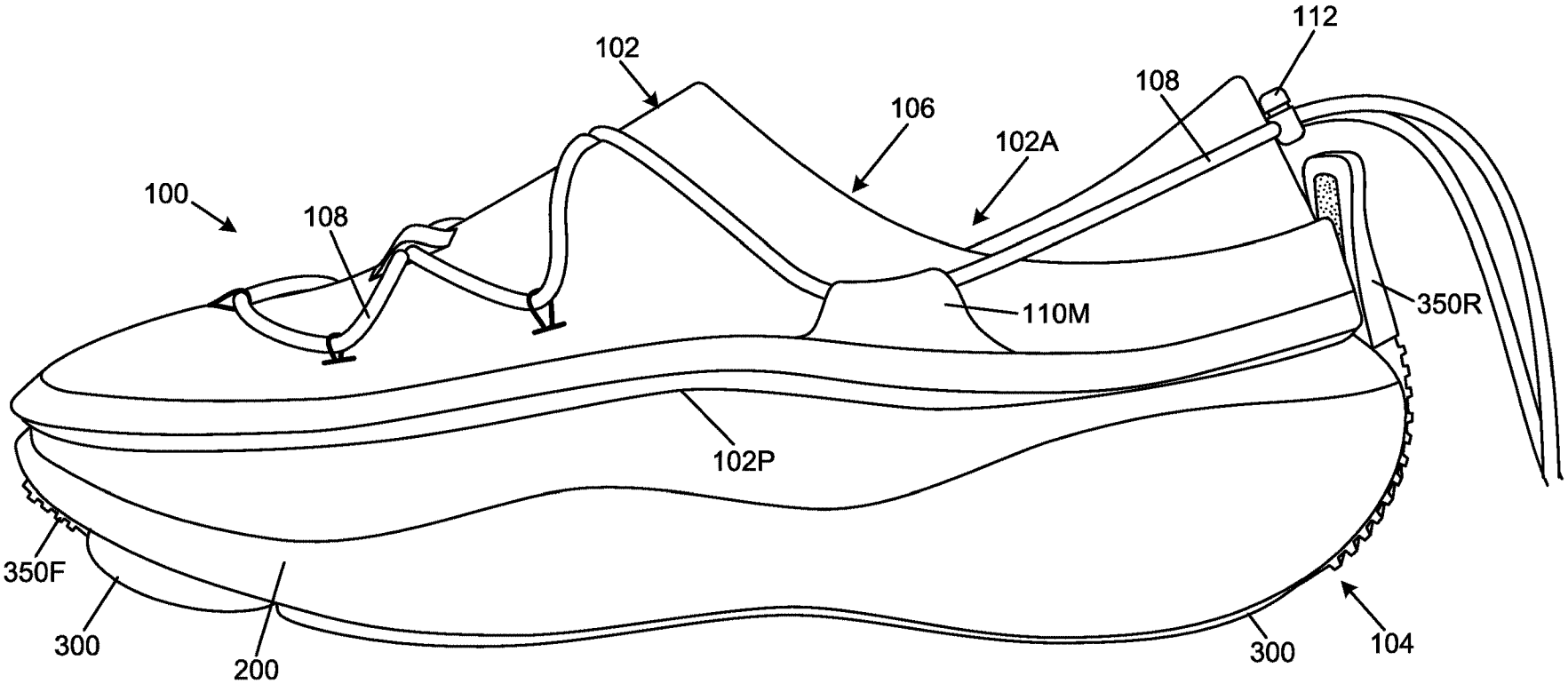

II. Detailed Description of Example Articles of Footwear, Sole Structures, and Other Components/Features According to Aspects of this Technology Referring to the figures and following discussion, examples of foot support components, sole structures, and articles of footwear in accordance with aspects of this technology are described. The article of footwear 100 of FIGS. 1A-1D includes an upper 102 and a sole structure 104 engaged with the upper 102. In the figures, FIG. 1A provides a front, lateral perspective view, FIG. 1B provides a rear, medial perspective view, FIG. 1C provides a lateral side view, and FIG. 1D provides a medial side view of an article of footwear 100 and sole structure 104 in accordance with some examples of this technology.

The upper 102 and sole structure 104 may be engaged together in any desired manner (such as by one or more of adhesives or cements, stitching or sewing, mechanical connectors, etc.), including in manners conventionally known and used in the footwear arts. In some examples or aspects of this technology, however, the upper 102 will be attached to a midsole component 200 of the overall sole structure 104, e.g., by stitching or sewing (in some examples solely by stitching or sewing) and/or by one or more hook-and-loop fastener connections (in some examples solely by one or more hook-and-loop fastener connections). Suitable hook-and-loop fasteners (e.g., hook-and-loop fasteners with strong holding strength) are known and commercially available, e.g., under the VELCRO® brand from Velcro Companies, from 3M Company, etc.).

Figure 2A:
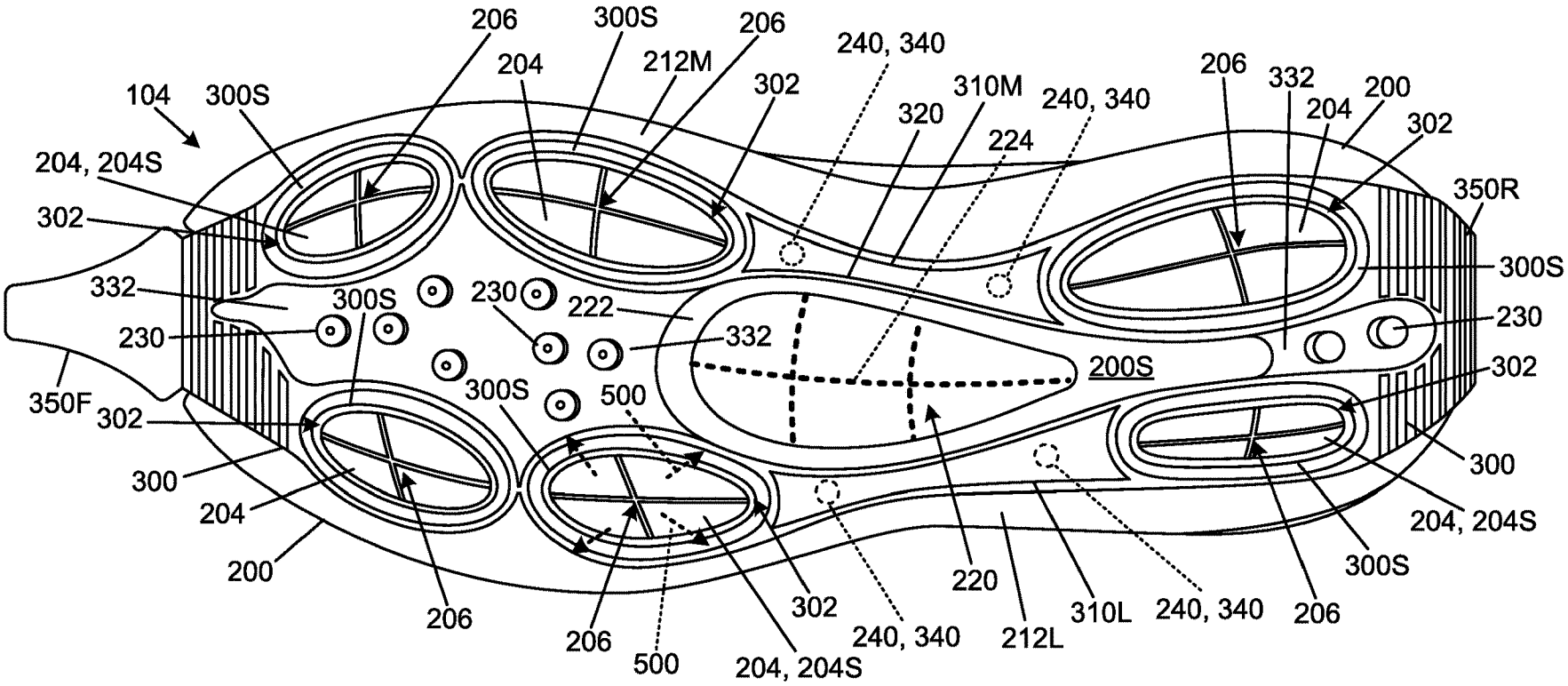
FIGS. 2A-2E provide various views of a sole structure in accordance with some examples of this technology.
Figure 2B:
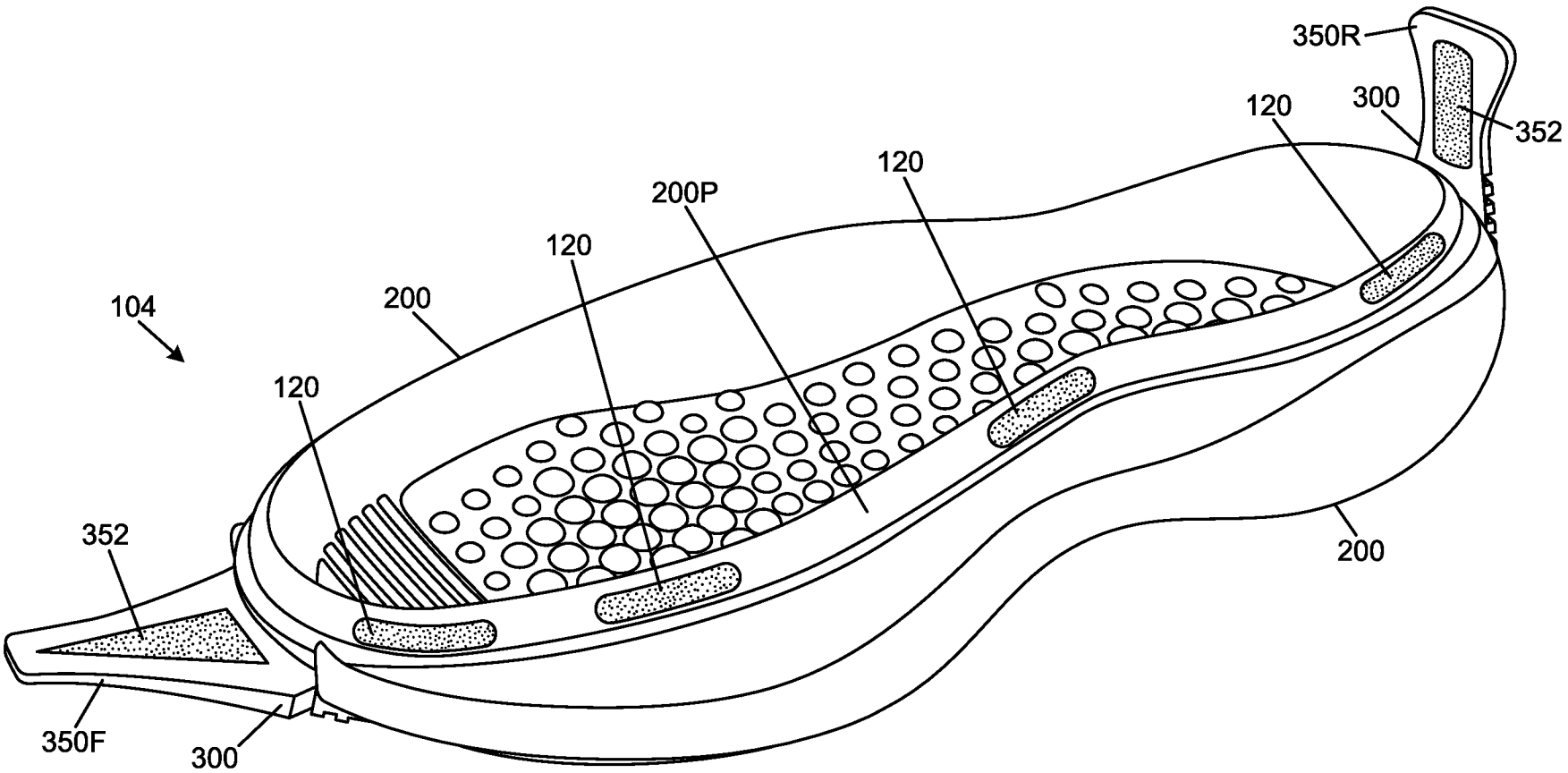
Figure 2C:
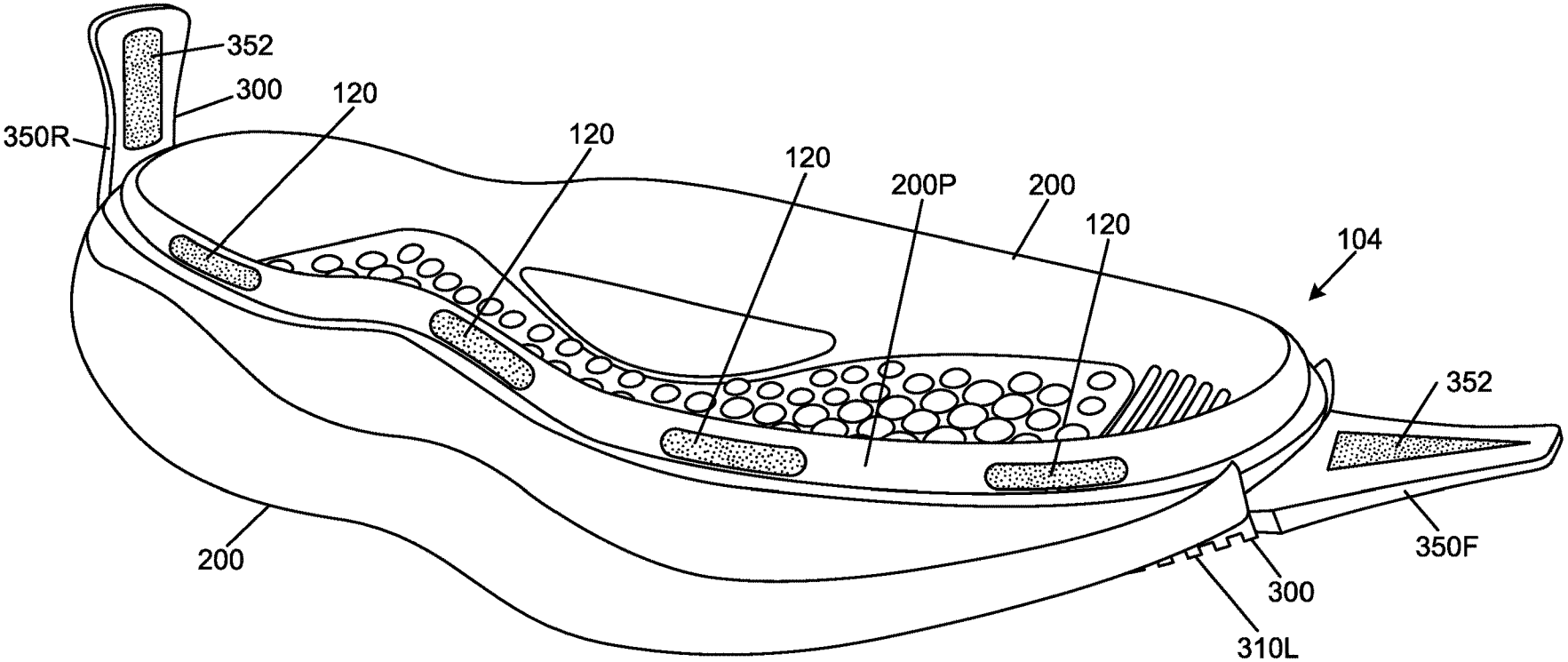

FIGS. 2B-2D, 3C-3J, and 4A-4K show that midsole components 200 of these illustrated examples include an indented or recessed top perimeter rim 200P around at least a portion of the top perimeter of the midsole component 200. This indented or recessed top perimeter rim 200P provides surface area to engage a bottom perimeter rim 102P of upper 102. See FIGS. 1A-1D. In some examples of this technology, an adhesive may be applied to one or both of rims 200P and/or 102P, and this adhesive will permanently fix (or destructively engage) the upper 102 to the midsole component 200. In other examples of this technology, however, one or more portions of a hook-and-loop fastener may be applied to the top perimeter rim 200P of the midsole component 200 and to the bottom perimeter rim 102P of the upper 102 (e.g., by stitching, by adhesives, etc.). Portions of hook-and-loop fasteners are represented in FIGS. 2B and 2C at reference number 120. One or more hook-and-loop fasteners 120 may be provided around the perimeter rims 102P and 200P, and the hook-and-loop fastener(s) 120 may extend to cover any desired percentage of the circumference of the perimeter rims 102P and 200P. In this manner, the upper 102 may be removably engaged with the midsole component 200 by engagement of the hook-and-loop fasteners 120. In this illustrated example, the bottom perimeter rim 102P of the upper 102 fits over and covers the top perimeter rim 200P of the midsole component 200 (although the top perimeter rim 200P of the midsole component 200 could fit over and cover all or at least some portion of the bottom perimeter rim 102P of the upper 102, if desired).

Alternatively, if desired, the upper 102 and sole member 104 could be engaged by sewing. This would enable the upper 102 and sole member 104 to still be separated, e.g., for recycling purposes.

The upper 102 (which may be formed from one or more parts), potentially together with the sole structure 104, defines a foot-receiving interior chamber 106 for containing a wearer's foot. The bottom of the upper 102 may include a strobel or other component engaged with or integrally formed with another portion of the upper 102 to close off the bottom of the upper 102. The upper 102 may include other components as well. For example, the upper 102 may include a tongue member located across the foot instep area and positioned to moderate the feel of the footwear's closure system on the wearer's foot; a closure system (e.g., including one or more of a lace type closure system, a zippered closure system, a buckle type closure system, one or more elastic stretch elements, etc.); a heel counter; a toe cap; securing straps; etc. Additionally or alternatively, the upper 102 may include a "sock-like" upper component, e.g., made from fabric and configured to closely fit the wearer's foot like a conventional sock. In the illustrated example, a lace element 108 extends over the instep area (in a crisscrossed manner), passes through one or more loops 110L, 110M located at a lateral side and a medial side of an ankle-containing portion 102A of the upper 102 (and/or adjacent a lateral side and a medial side of the opening for receiving a wearer's foot), and engages a tightening mechanism and/or lock mechanism 112. The lock mechanism 112 in this illustrated example is located at a rear heel area of the upper 102. At least some portion of the lace-engaging loop(s) 110L and/or 110M may be located between parallel planes located at 0.2L and 0.5L (and in some examples, between parallel places located at 0.25L and 0.45L).

The upper 102 may be made from any desired material(s) and/or in any desired constructions and/or manners without departing from this technology. As some more specific examples, all or at least a portion of the upper 102 (and optionally a majority, substantially all, or even all of the upper 102) may be formed as a woven textile component, a knitted textile component, another textile component, a natural leather component, a synthetic leather component, a polymeric component (e.g., a TPU, etc.), etc. The component(s) for upper 102 may have structures and/or constructions like those used in footwear products commercially available from NIKE, Inc. of Beaverton, OR and/or other manufacturers, including conventional structures and constructions as are known and used in the art.

Additionally or alternatively, if desired, the upper 102 construction may include foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers 102 and articles of footwear 100 in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, uppers 102 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, uppers of the types described in U.S. Pat. No. 7,347,011 and/or 8,429,835 may be used without departing from this technology (each of U.S. Pat. Nos. 7,347,011 and 8,429,835 is entirely incorporated herein by reference).

Figure 2D:
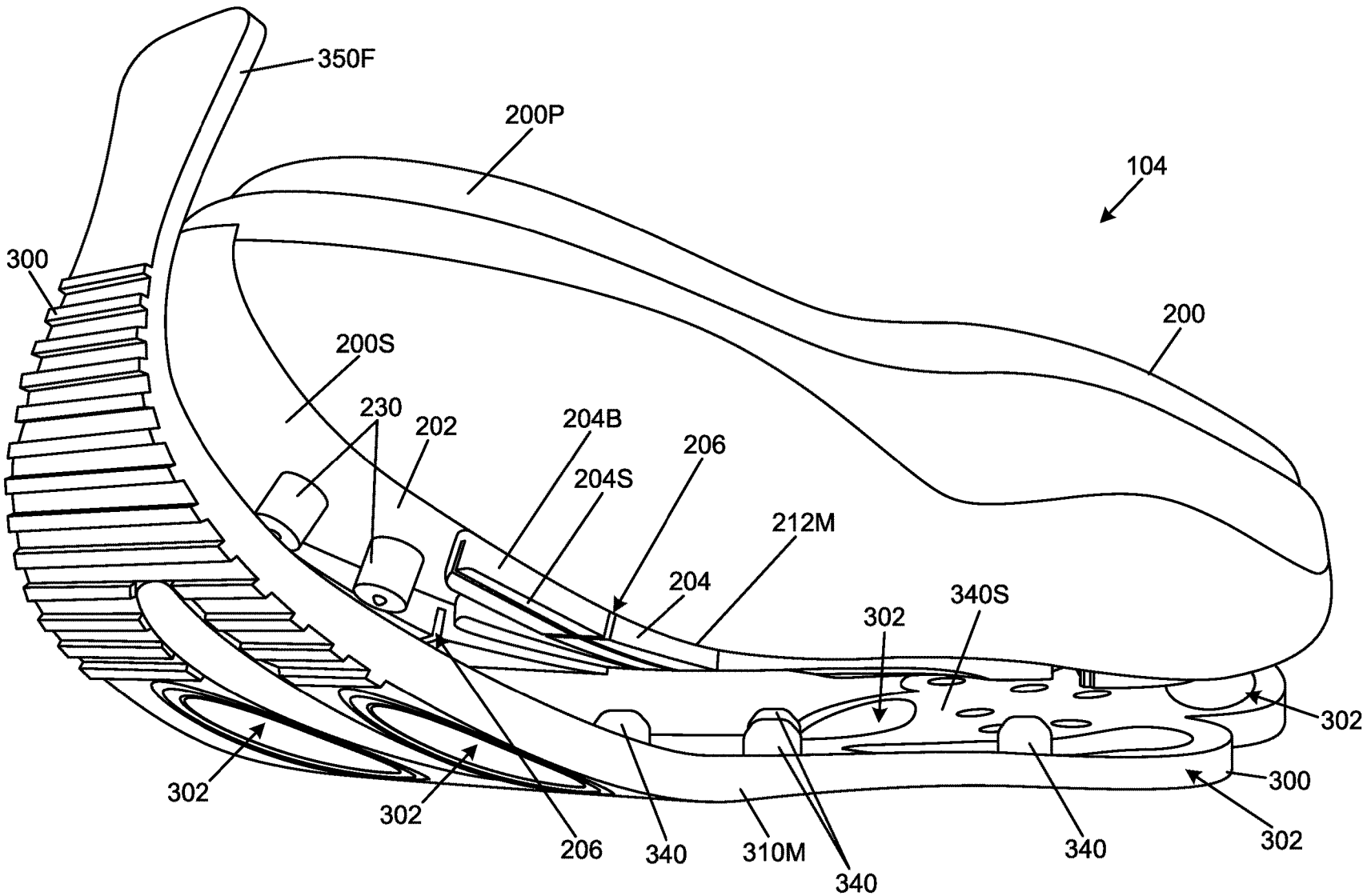
Figure 2E:
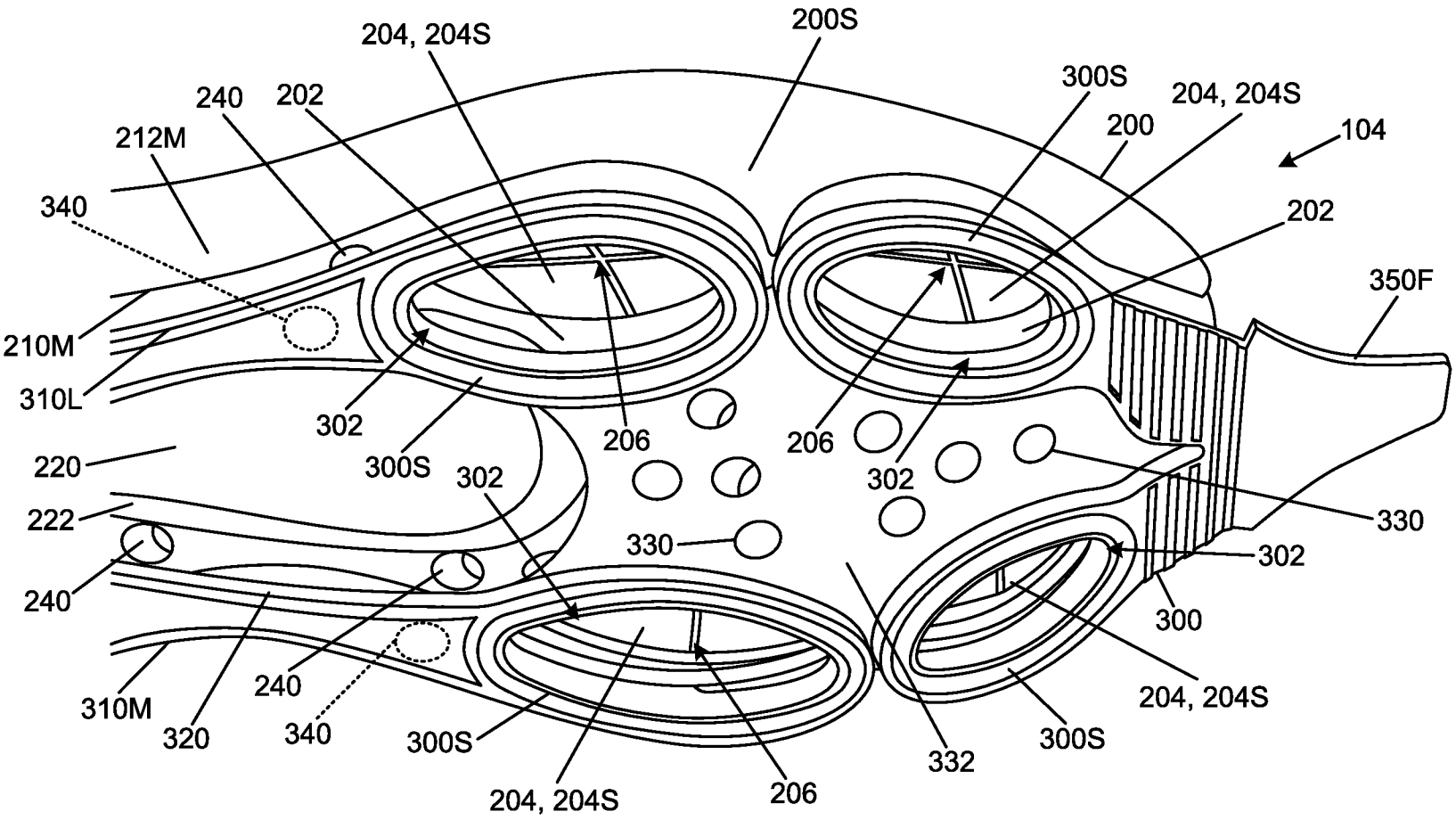
Figure 3A:
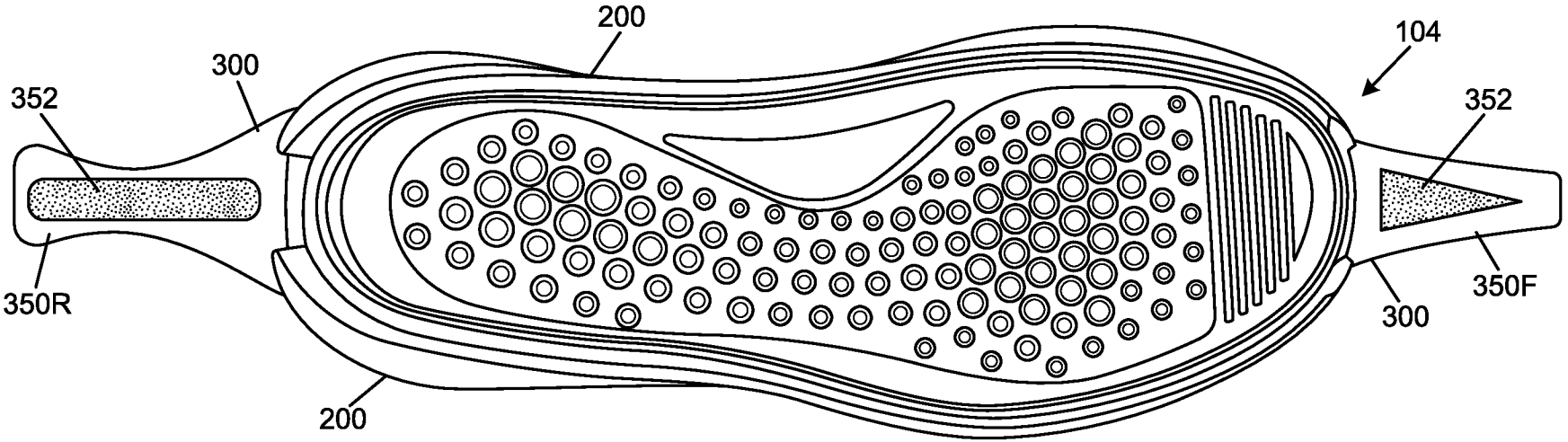
FIGS. 3A-3M provide various views of a sole structure in accordance with some examples of this technology.
Figure 3B:
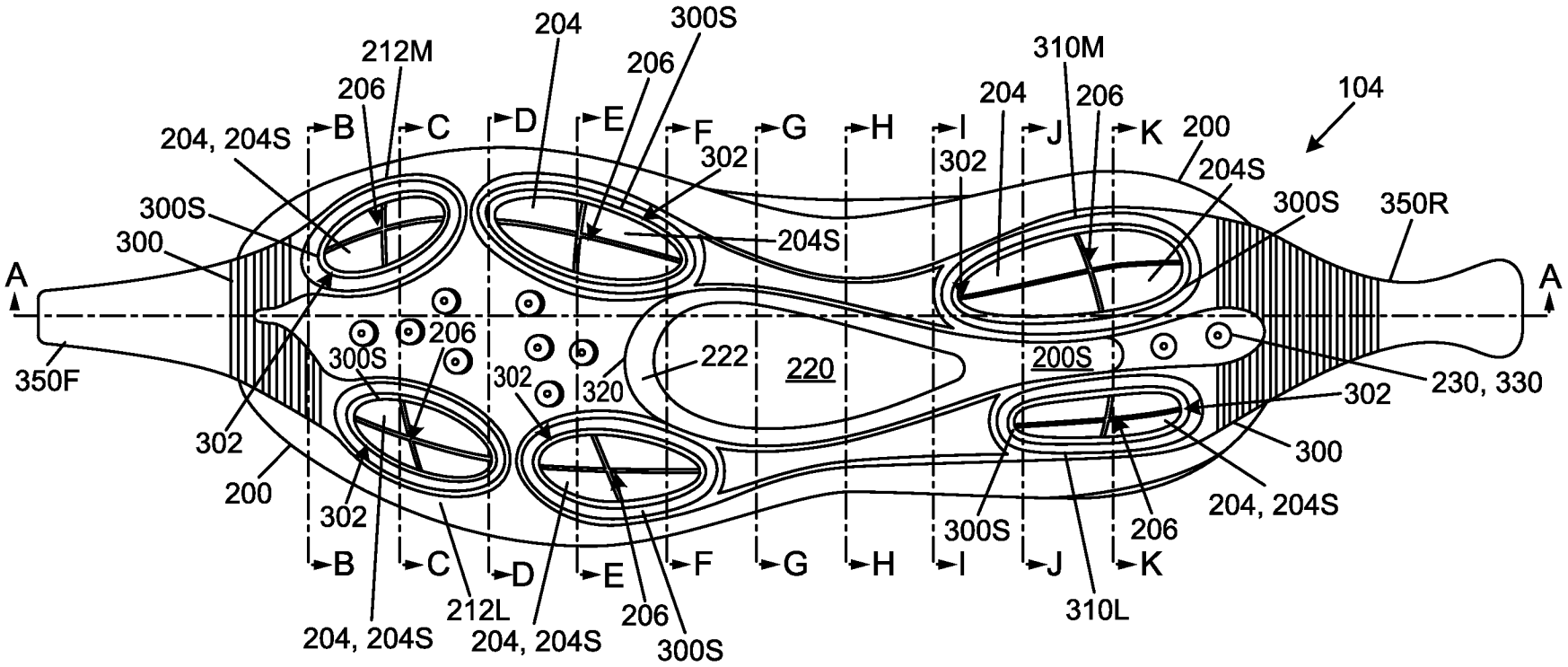
Figure 3C:
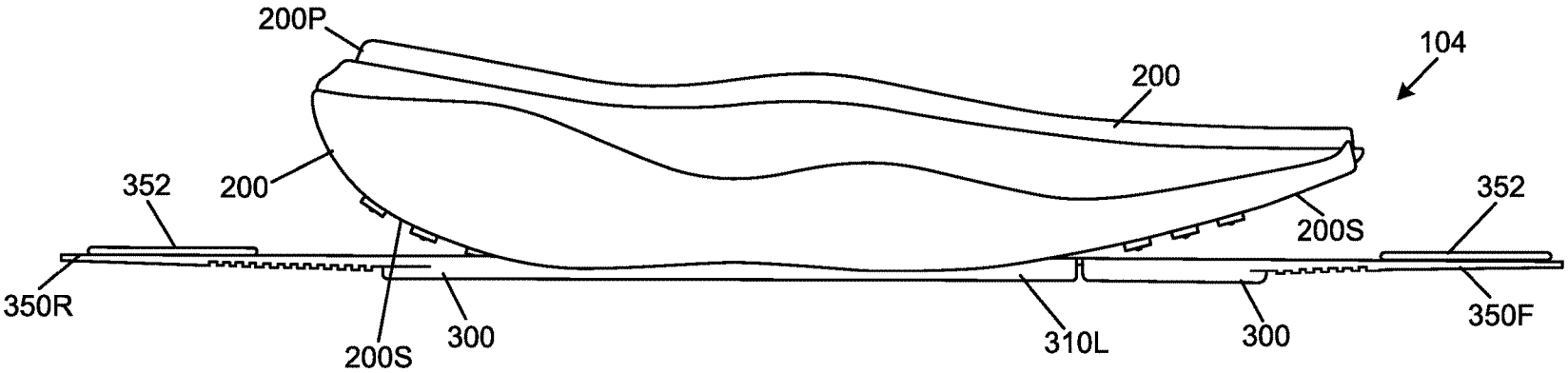
Figure 3D:
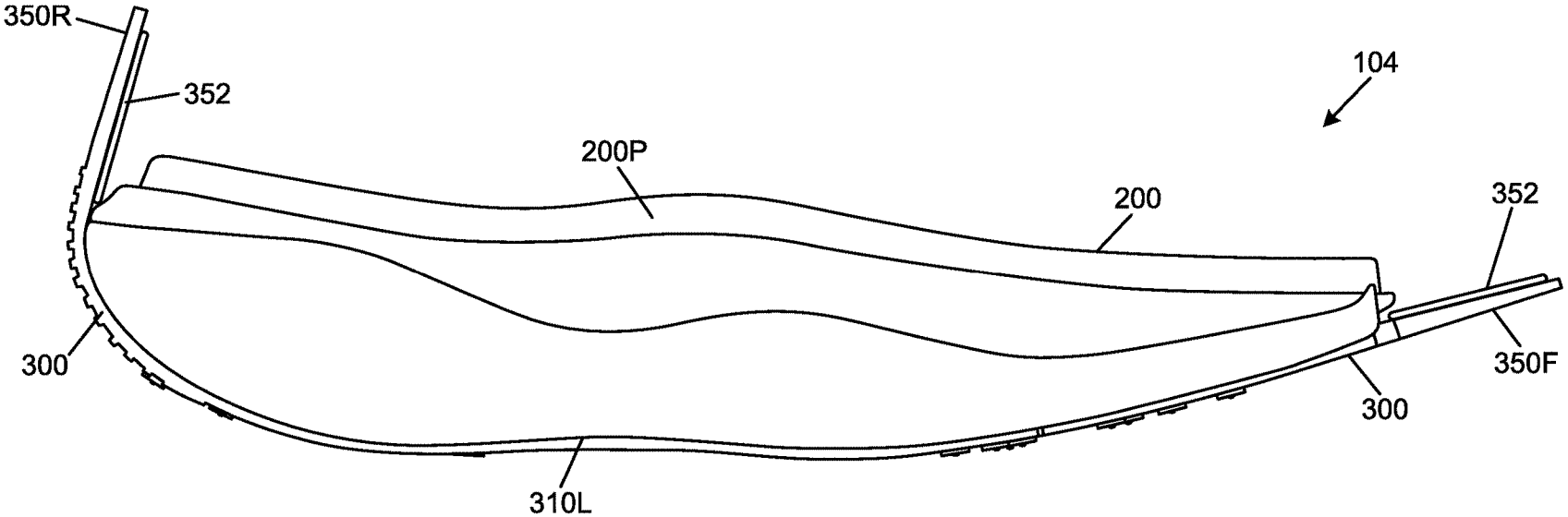
Figure 3E:
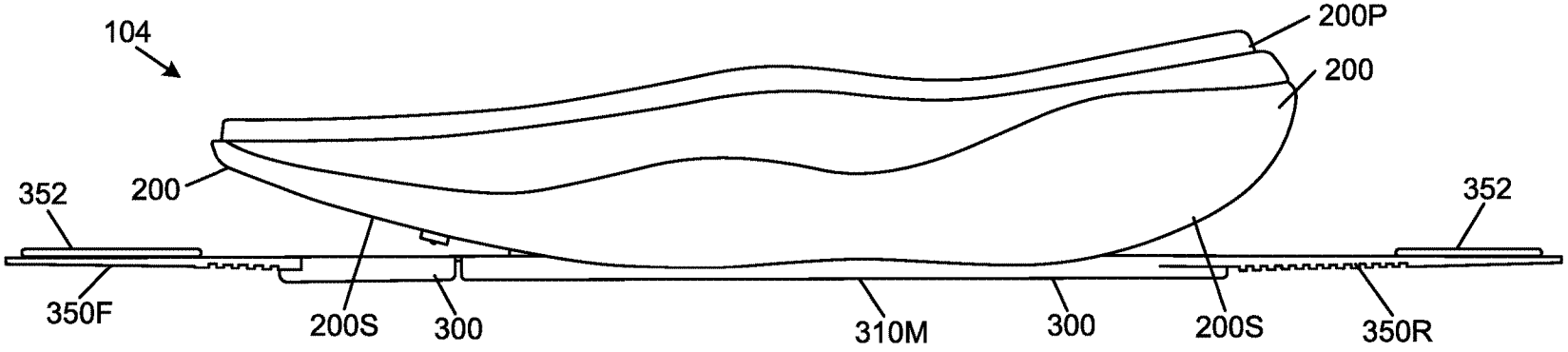
Figure 3F:
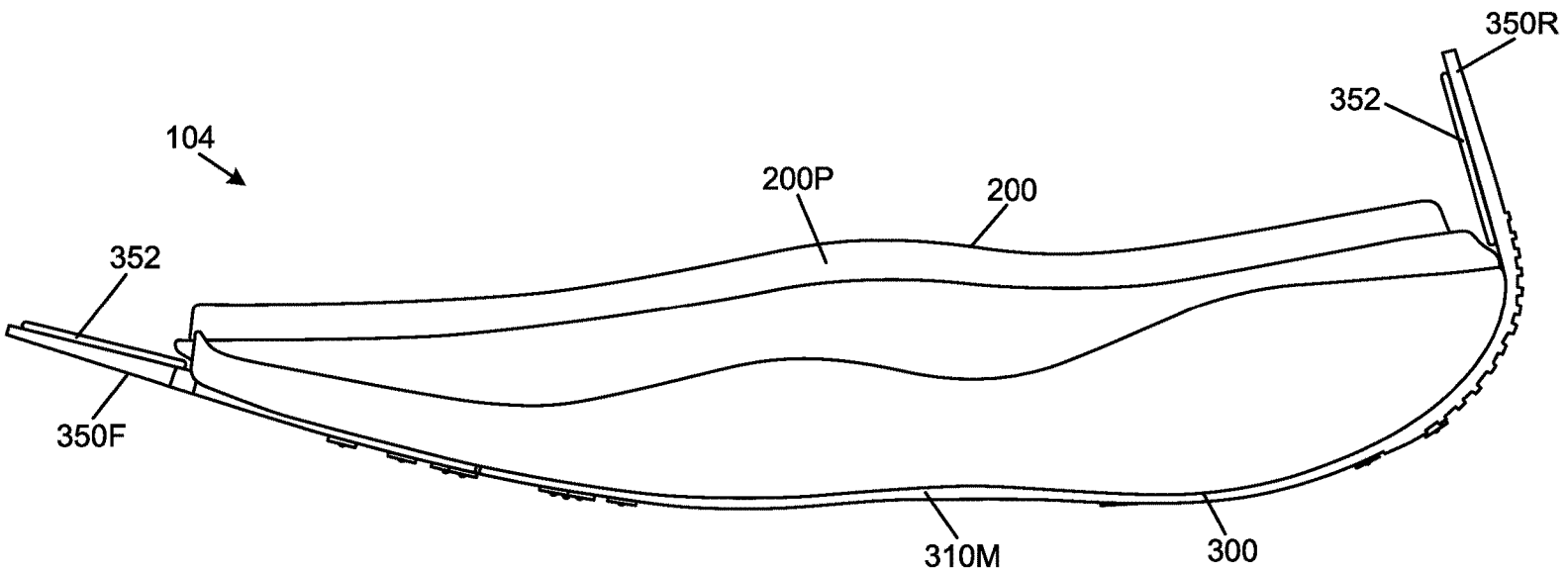
Figure 3G:
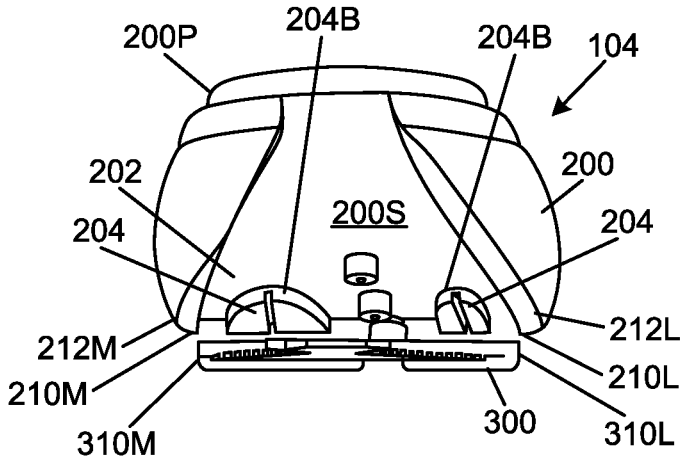
Figure 3H:
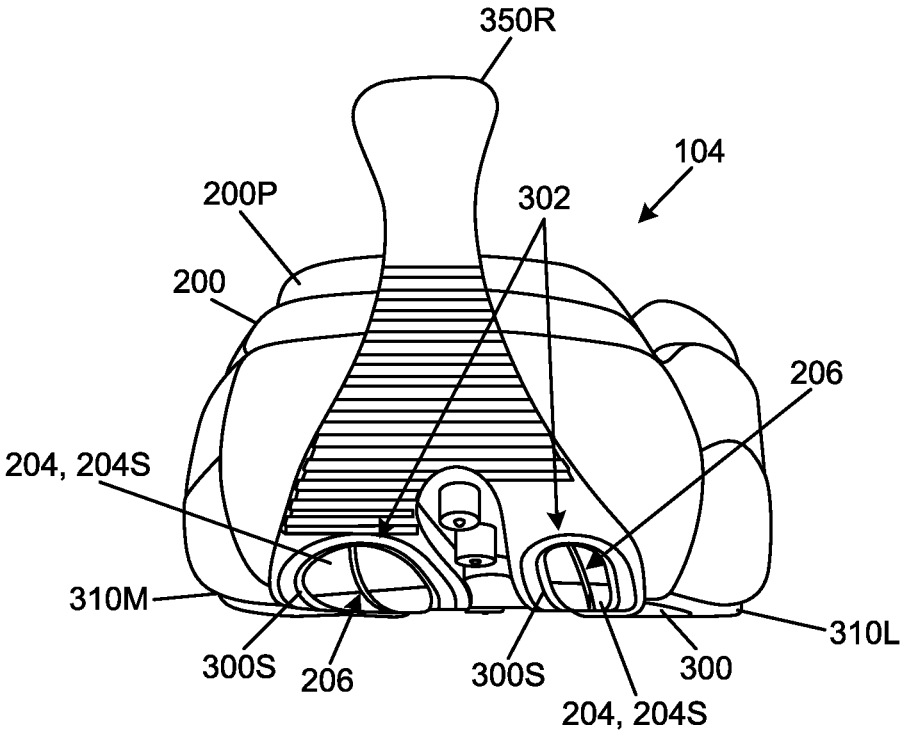
Figure 3I:
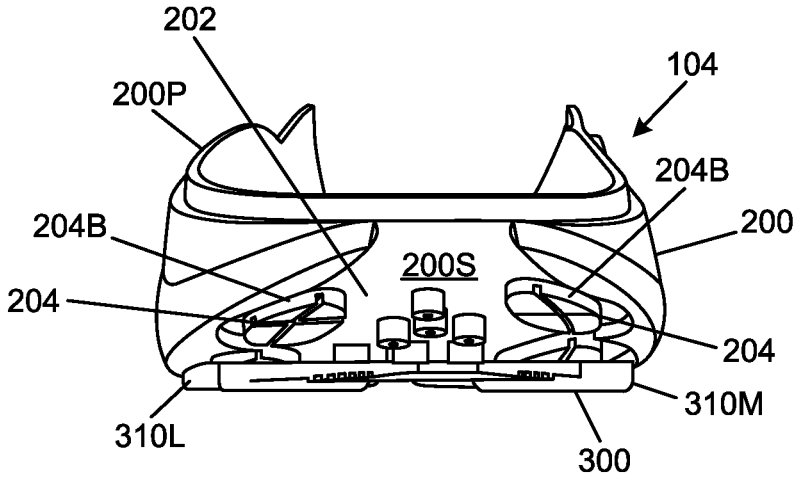
Figure 3J:
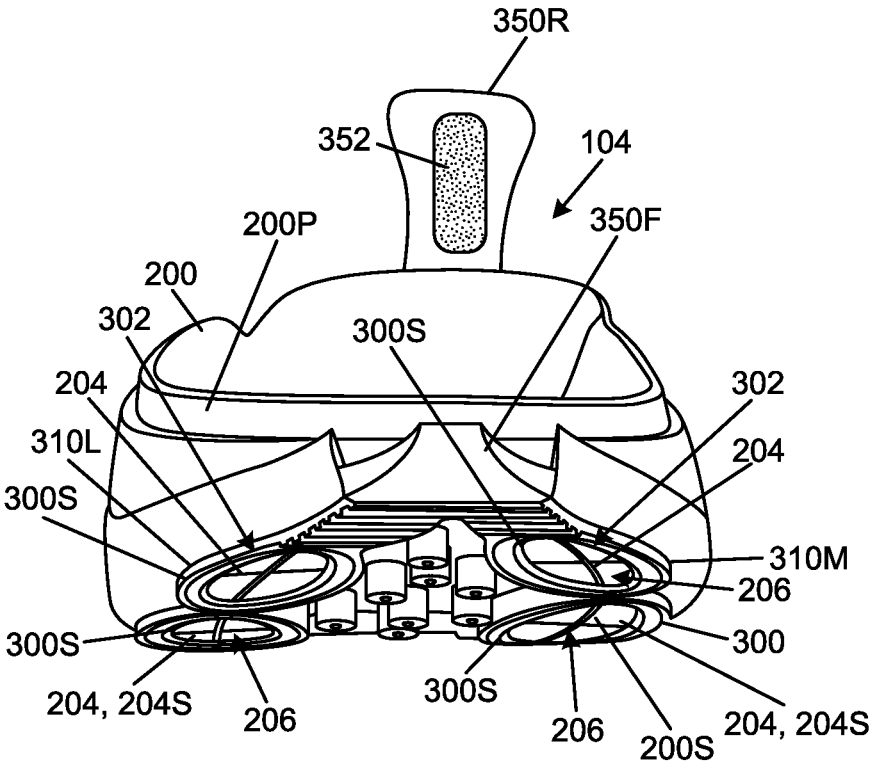
Figure 3K:
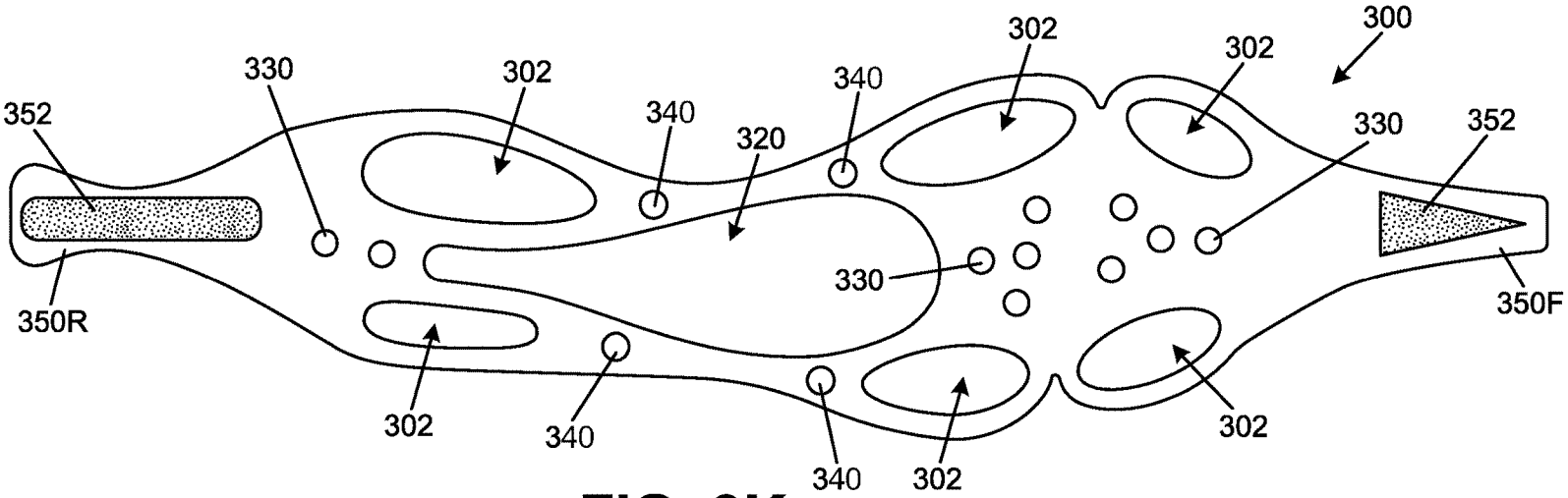
Figure 3L:
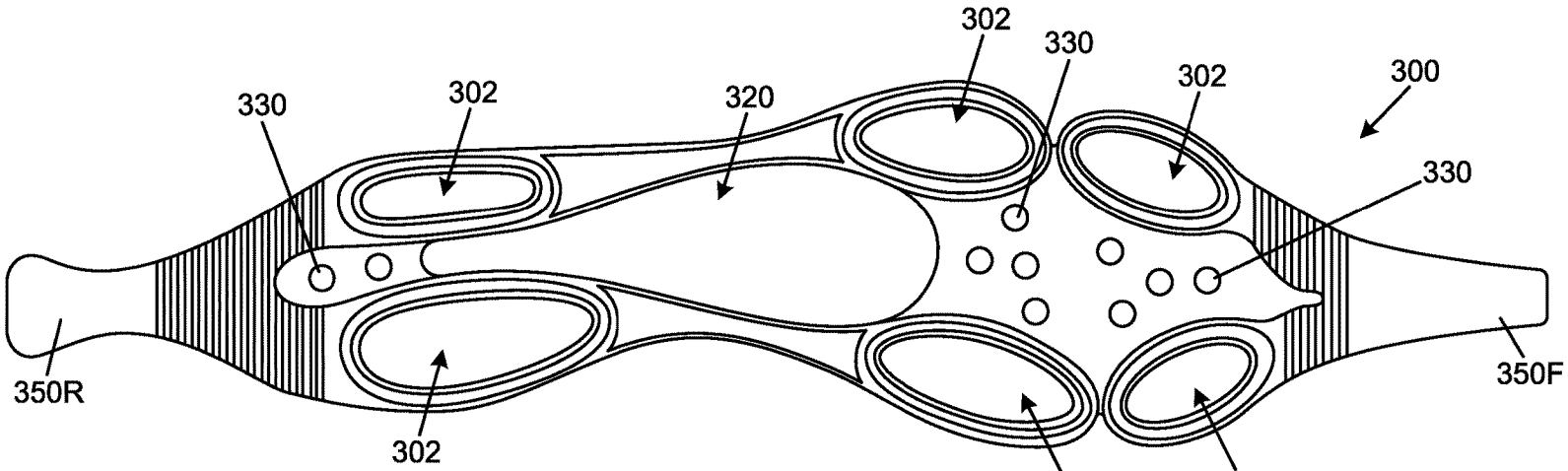
Figure 3M:
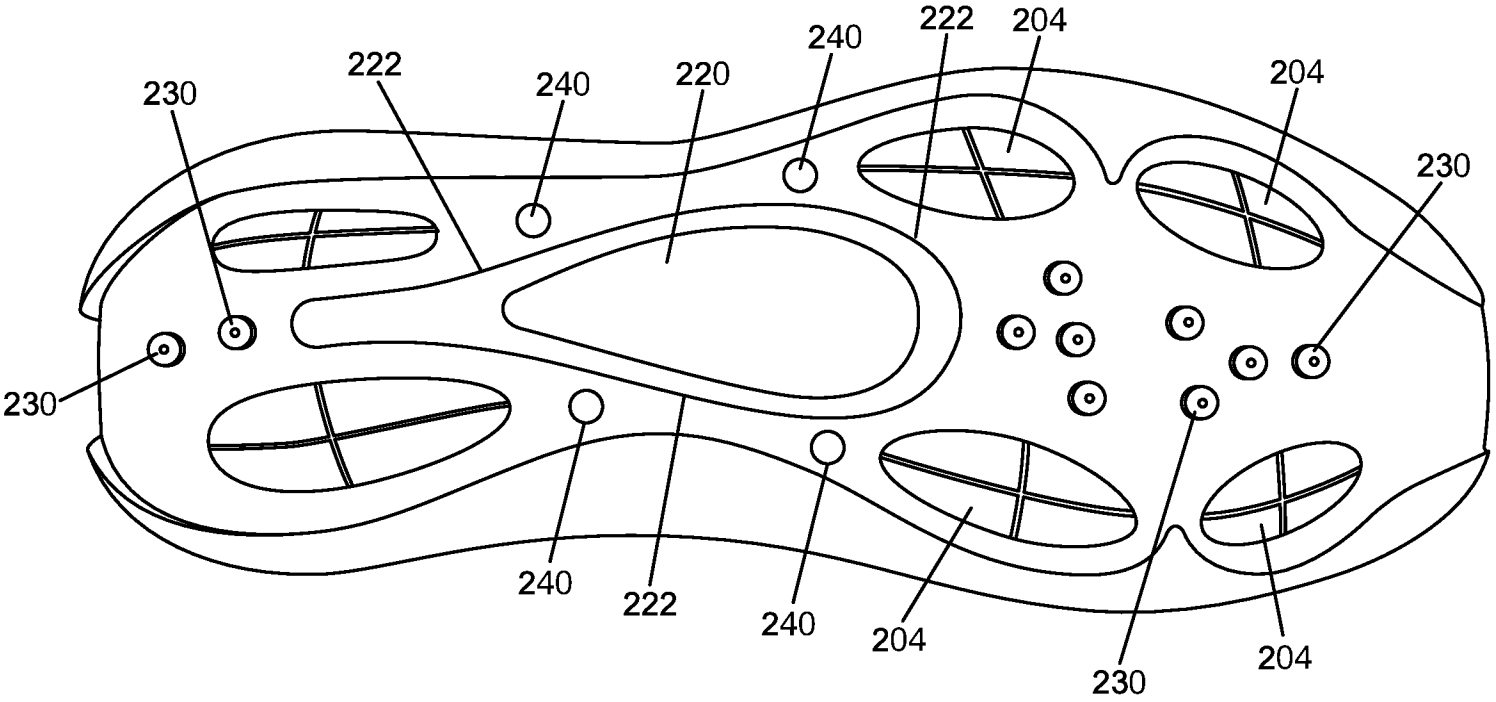

Example articles of footwear 100, sole structures 104, and components thereof now will be described in more detail in conjunction with FIGS. 2A-5B. FIG. 2A provides a bottom view, FIG. 2B provides a front, medial perspective view, FIG. 2C provides a front, lateral perspective view, FIG. 2D provides an exploded bottom, medial perspective view, and FIG. 2E provides an exploded bottom, front perspective view of a sole structure 104 in accordance with some examples and aspects of this technology. FIG. 3A provides a top view, FIG. 3B provides a bottom view, FIGS. 3C and 3D provide lateral side views, FIGS. 3E and 3F provide medial side views, FIGS. 3G and 3H provide rear views, FIGS. 31 and 3J provide front views of a sole structure 104 in accordance with some examples and aspects of this technology. FIGS. 3K and 3L provide top and bottom views, respectively, of the outsole component alone, and FIG. 3M provides a bottom view of the midsole component alone. FIGS. 4A-4K provide sectional views of a sole structure 104 according to some examples and aspects of this technology along the corresponding section lines shown in FIG. 3B. FIGS. 5A and 5B provide enlarged views of different structures that may be provided in the encircled area labeled "5A, 5B" in FIG. 4E.

The sole structures 104 of these illustrated examples include multiple parts, including a midsole component 200 (e.g., made from one or more component parts) and an outsole component 300 (e.g., made from one or more component parts). The midsole component(s) 200 may be made from any desired material and/or of any desired construction, including conventional materials (e.g., polymeric foam material(s), ethylvinylacetate (EVA) foam(s), polyurethane foam(s), etc.) and conventional constructions (e.g., optionally including one or more fluid-filled bladders, one or more mechanical shock absorbing components, etc.) as are known and used in the footwear art. The outsole component(s) 300 may be made from any desired material and/or of any desired construction, including conventional materials (e.g., rubber material(s), thermoplastic polyurethane material(s), etc.) and conventional constructions as are known and used in the footwear art. As mentioned above, in some examples of this technology, the outsole component 300 may releaseably engage with the midsole component 200. Portions of the description below will highlight structures and features that provide and/or support the releasable engagement and/or stable engagement of the outsole component 300 and midsole component 200 in accordance with some examples of this technology.

In this example sole structure 104, the midsole component 200 has a bottom surface 200S that is partially exposed at the bottom of the final assembled sole structure 104 and article of footwear 100. This bottom surface 200S includes: (i) a base surface 202 and (ii) one or more (and optionally, a plurality of) projections 204 extending away from the base surface 202 (extending downward when the sole structure 104 is supported on a horizontal base surface on its ground-facing surface). One or more of the projections 204 in this illustrated example sole structure 104 (including all of the projections 204) include a main body 204B extending away from the base surface 202 (e.g., a cylindrical structure). An exposed free end surface 204S of one or more of the projection(s) 204 may include one or more sipes 206 (and in some examples a pair of intersecting sipes 206) extending inward into the body 204B.

Further, this example sole structure 104 includes an outsole component 300 that is optionally removably engaged with the midsole component 200. This outsole component 300 includes one or more (and optionally, a plurality of) holes 302 defined therein (e.g., through holes). These holes 302 are structured and arranged such that each hole 302 receives one of the corresponding projections 204 (which extends into the hole 302). The hole(s) 302 may be sized and/or shaped to be somewhat smaller than the projection 204 it is designed to receive, e.g., 1-4 mm smaller around the perimeter or circumference of its interior surface, to assure a tight fit as the outsole component 300 hole 302 stretches around the outer perimeter surface of the projection 204. As shown in FIGS. 2A, 2E, 3B, 3H, 3J, 4C-4F, 4J, 4K, 5A, and 5B, the exposed free end surface(s) 204S of the projection(s) 204 is (are) exposed through an open end of the hole 302 into which the projection 204 extends. The exposed free end surface(s) 204S of the projection(s) 204 of this illustrated example sole structure 104 is (are) recessed inward from an exposed exterior surface 300S of the outsole component 300 immediately adjacent the hole 302 through which the free end surface 204S is exposed. This recessed distance (see D2 in FIG. 5A) may be from 1 to 12 mm, and in some examples, from 1 to 10 mm or even from 1.5 to 8 mm. Thus, the outsole component 300 extends downward further than the midsole component 200 at the projection 204/hole 302 locations (e.g., at least when no external force is applied to the sole structure 104).

As shown in FIGS. 5A and 5B, in at least some examples of this technology, the outsole component 300 may be made somewhat thicker at locations immediately adjacent the hole(s) 302, e.g., to provide structural support, wear resistance, etc. As some more specific examples, the surface of the outsole component 300 forming the hole(s) 302 may have a thickness (in the vertical direction of FIGS. 5A and 5B) within a range of 3 mm to 25 mm, and in some examples, from 4 mm to 22 mm or even from 4 mm to 20 mm. Additionally or alternatively, the exposed surface 300S of the outsole component 300 may include traction elements, such as recesses (e.g., as shown in FIGS. 5A and 5B), raised ribs, separate traction elements, etc.

While any desired number and/or arrangement of projections 204 and corresponding holes 302 of this type may be provided (e.g., from 1 to 12), in this illustrated example sole structure 104, six (e.g., first through sixth) relatively large and siped projections 204 and six (e.g., first through sixth) relatively large holes 302 are provided—three located toward the lateral side (or outside edge) of the sole structure 104 and three located toward the medial side (or inside edge) of the sole structure 104. There are two forefoot supporting projections 204 and corresponding holes 302 (one on each side in the forefoot region of the sole structure 104), two ball of the foot supporting projections 204 and corresponding holes 302 (one on each side in the forefoot and/or midfoot region of the sole structure 104), and two heel supporting projections 204 and corresponding holes 302 (one on each side in the heel region of the sole structure 104). Some examples of this technology will include sole structures 104 having any combination of two or more of the foot supporting projections 204 and corresponding hole 302 combinations, e.g., in any combination of the positions shown in the figures. When multiple projections 204 and corresponding holes 302 are present in a sole structure 104, the projections 204 may have the same or different structures and/or shapes (e.g., each having a main body 204B, an exposed free end surface 204S, and/or a pair (or more) intersecting sipes 206, etc.). Similarly, the holes 302 may have the same or different structures and/or shapes (e.g., extending outward beyond the free end surface 204S the same or different distances, the same or different thicknesses at the hole 302 opening location, the same or different stretchability, etc.).

The midsole component 200 and the outsole component 300 of this example are removably engaged together at least in part through use of the projections 204 and the holes 302 (e.g., held together by a tight fit or friction fit). These projections 204 and holes 302 are relatively large, providing relatively large interfacing areas (e.g., areas where a side surface of the projection 204 main body 204B contacts a side surface defining the hole 302 in the outsole component 300).

As some more specific examples, one or more of the free end surfaces 204S of the projections 204 and/or the transverse cross-sectional areas of the projections 204 (e.g., cross-sections substantially parallel to the free end surface 204S or perpendicular to base surface 200S) may be at least 300 $mm^2$, and in some examples, at least 400 $mm^2$, at least 500 $mm^2$, or even at least 600 $mm^2$. Additionally or alternatively, as some additional specific examples, one or more of the free end surfaces 204S of the projections 204 and/or the transverse cross-sectional areas of the projections 204 (e.g., cross-sections substantially parallel to the free end surface 204S or perpendicular to base surface 200S) may be less than 8000 $mm^2$, and in some examples, less than 7000 $mm^2$, less than 6000 $mm^2$, less than 5000 $mm^2$, less than 4000 $mm^2$, less than 3000 $mm^2$, less than 2000 $mm^2$, or even less than 1000 $mm^2$. The corresponding holes 302 may be within any of these same size ranges (or stretchable to these size ranges) to receive a corresponding projection 204.

As mentioned above, the illustrated sole structure 104 includes six total large projection 204/hole 302 pairs: (a) two forefoot supporting pair, (b) two ball of the foot supporting pair (e.g., metatarsal head supporting pair), and (c) two heel supporting pair. All of the illustrated large projection 204/hole 302 pairs are elongated in the longitudinal direction L of the sole structure 104 (although this is not a requirement in all examples of this technology). While other options are possible: (a) one or both of the two forefoot supporting large projection 204/hole 302 pair may be located between parallel planes (as described above) located at 0.65L and 0.98L, and in some examples between parallel planes located at 0.7L and 0.96L (between 0.72L and 0.94L in the illustrated example); (b) one or both of the two ball of the foot supporting large projection 204/hole 302 pair may be located between parallel planes located at 0.45L and 0.85L, and in some examples between parallel planes located at 0.5L and 0.8L (between 0.52L and 0.77L in the illustrated example); and/or (c) one or both of the two heel supporting large projection 204/hole 302 pair may be located between parallel planes located at 0.02L and 0.45L, and in some examples between parallel planes located at 0.04L and 0.4L (between 0.06L and 0.32L in the illustrated example). Each large projection 204/hole 302 pair may span at least 50% (and in some examples, at least 60%, at least 75%, or even at least 90%) of the distance between the parallel planes for the ranges described above. Additionally or alternatively, in some examples of this technology: (a) at least 50% of the surface area and/or volume of one or both of the two forefoot supporting large projection 204/hole 302 pair will be located between parallel planes located at 0.65L and 0.98L, and in some examples between parallel planes located at 0.7L and 0.96L or between parallel planes located at 0.72L and 0.94L; (b) at least 50% of the surface area and/or volume of one or both of the two ball of the foot supporting large projection 204/hole 302 pair will be located between parallel planes located at 0.45L and 0.85L, and in some examples between parallel planes located at 0.5L and 0.8L or between parallel planes located at 0.52L and 0.77L; and/or (c) at least 50% of the surface area and/or volume of the two heel supporting large projection 204/hole 302 pair will be located between parallel planes located at 0.02L and 0.45L, and in some examples between parallel planes located at 0.04L and 0.4L or between parallel planes located at 0.06L and 0.32L. At least 60%, at least 75%, or even at least 90% of the surface area and/or volume of the large projection 204/hole 302 pairs may be located within the parallel plane ranges described above. Some sole structures 104 in accordance with aspects of this technology will consist of or consist essentially of six total large projection 204/hole 302 pairs, e.g., having the size and/or position features described herein.

FIGS. 2A, 2D, 2E, 3B, 3G, 4B-4D, 4K, 5A, and 5B further show that the base surface 202 (at the bottom surface 200S) of the midsole component 200 according to at least some aspects of this technology includes a lateral side ridge 210L and a medial side ridge 210M. These side ridges 210L, 210M extend away from the base surface 202 (e.g., in a substantially vertical direction when the sole structure 104 is arranged horizontally on its ground-facing surface). As further shown in these figures, at least a portion of an outermost exterior lateral edge 310L of the outsole component 300 extends (and is located) inside the lateral side ridge 210L and/or at least a portion of an outermost exterior medial edge 310M of the outsole component 300 extends (and is located) inside the medial side ridge 210M. In this manner: (a) the midsole component 200 portion located outside the lateral side ridge 210L defines at least a portion of a lateral side bottom outermost perimeter surface 212L of the sole structure 104, (b) the midsole component 200 portion located outside the medial side ridge 210M defines at least a portion of a medial side bottom outermost perimeter surface 212M of the sole structure 104, (c) at least a portion of the exposed outermost exterior lateral edge 310L of the outsole component 300 does not extend to the outermost exterior bottom perimeter edge of the sole structure 104, and (d) at least a portion of the exposed outermost exterior medial edge 310L of the outsole component 300 does not extend to the outermost exterior bottom perimeter edge of the sole structure 104. In at least some examples of this technology, at least 60%, at least 70%, at least 80%, or even at least 90% of the bottom outermost perimeter surface of the sole structure 104 will be formed by the midsole component 200 (including lateral side bottom outermost perimeter surface 212L and medial side bottom outermost perimeter surface 212M).

The bottom surface 200S of midsole components 200 of sole structures 104 in accordance with at least some examples of this technology may include a central arch recess 220. In some examples, this central arch recess 220 extends inward from the base surface 202 of the midsole component 200 and will be located between the lateral side region and the medial side region of the midsole (e.g., between lateral side ridge 210L and medial side ridge 210M, if they are present in the arch area and/or the sole structure 104). A central arch opening 320 defined through the outsole component 300 may fit around the central arch recess 220 (e.g., optionally around a raised ridge or raised surface 222 defining an edge of the central arch recess 220) so that the central arch recess 220 is exposed at a bottom of the final assembled sole structure 104. The opening to the central arch recess 220 (its perimeter) may be relatively large, e.g., enclosing an area of at least 300 $mm^2$, and in some examples, at least 400 $mm^2$, at least 500 $mm^2$, at least 600 $mm^2$, at least 750 $mm^2$, at least 900 $mm^2$, or even at least 1000 $mm^2$. In the illustrated example, the central arch recess 220 is ovoid or teardrop shaped (with its narrow end located closer to the heel region of the sole structure 104) having an inwardly (upwardly) curved exposed surface (e.g., smoothly curved). The central arch opening 320 defined through the outsole component 300 may be sized and shaped to be somewhat smaller than the raised ridge or raised surface 222 defining the edge of the central arch recess 220, e.g., 1-4 mm smaller around the perimeter or circumference of its interior surface, to assure a tight fit as the outsole component 300 central arch opening 320 stretches around the outer perimeter of the raised ridge or surface 222. The raised ridge or surface 222 may have a width dimension W1 (i.e., a dimension directly across the raised ridge 222, see FIG. 4G) around at least 50% of its outer perimeter from 2 to 12 mm wide (and in some examples, from 2.5 to 10 mm wide or even from 3 to 8 mm wide around at least 50% of its outer perimeter). These width dimension W1 ranges may be present around at least 60%, at least 75%, at least 85%, or even at least 90% of the raised surface or ridge 222 defining the central arch recess 220.

While other options are possible, in some examples of this technology, the central arch recess 220 will be located between parallel planes located at 0.2L and 0.7L, and in some examples between parallel planes located at 0.25L and 0.65L (between 0.3L and 0.59L in the illustrated example). Additionally or alternatively, in some examples of this technology, at least 50% of the surface area and/or volume of the central arch recess 220 will be located between parallel planes located at 0.2L and 0.7L, and in some examples between parallel planes located at 0.25L and 0.65L or between parallel planes located at 0.3L and 0.59L in the illustrated example. At least 60%, at least 75%, or even at least 90% of the surface area and/or volume of the central arch recess 220 may be located within the parallel plane ranges described above. The central arch opening 320 for receiving the raised surface or ridge 222 defining the central arch recess 220 may be located between parallel planes located at 0.08L and 0.7L, and in some examples between parallel planes located at 0.1L and 0.65L (between 0.14L and 0.59L in the illustrated example). Some sole structures 104 in accordance with aspects of this technology will consist of or consist essentially of one central arch recess 220, e.g., having the size and/or position features described herein.

In addition to (or as an alternative to) the large projection 204 and hole 302 pairs, the midsole component 200 of this example sole structure 104 includes one or more smaller protrusions 230 (extending downward or outward from base surface 202 of the midsole component 200's bottom surface 200S). The protrusion(s) 230 fit into one or more additional smaller holes 330 (e.g., through holes) defined in the outsole component 300. The protrusion 230/through hole 330 pairs fit together, e.g., to help hold the midsole component 200 and outsole component 300 together and in place with respect to one another. As shown in FIGS. 2A, 3K, and 3L, the through holes 330 for the protrusion 230/through hole 330 pairs are defined through a base surface 332 of the outsole component 300. The base surface 332 may be somewhat thinner (e.g., less than 5 mm thick, and in some examples less than 4 mm thick, less than 3 mm thick, or even less than 2 mm thick) than the areas of the outsole component 300 forming the exposed exterior surface(s) 300S of the outsole component 300 immediately adjacent the hole(s) 302 through which the free end surface(s) 204S is (are) exposed (which may be at least 5 mm thick, at least 6 mm thick, or even at least 7.5 mm thick). The thinned base surfaces 332 of this example are located in the forefoot region and the heel region, e.g., forward and aft from the central arch recess 220 in this example (although a central arch recess 220 need not be present to have one or more thinned outsole base surfaces 332 and/or protrusion 230/through hole 330 pair(s) in the areas shown). The thinned base surfaces 332 may help improve sole flexibility, and/or help promote more natural flexion of the outsole component 300, e.g., as a wearer moves.

As noted above, the protrusion(s) 230 and corresponding hole(s) 330 may be relatively small (e.g., as compared to the projections 204 and their holes 302). As some more specific examples, one or more of the protrusions 230 and holes 330 may have a transverse cross sectional area of less than 200 $mm^2$, and in some examples, less than 175 $mm^2$, less than 150 $mm^2$, less than 125 $mm^2$, or even less than 100 $mm^2$. Additionally or alternatively, if desired, the transverse cross sectional area of protrusion(s) 230 and corresponding hole(s) 330 pair(s) may be less than 25% of the transverse cross sectional area of a closest projection 204/hole 302 pair (and in some examples, less than 20%, less than 15%, or even less than 10%). As some additional or further alternative features, if desired, the transverse cross sectional area of a plurality of the protrusion(s) 230 and corresponding hole(s) 330 pairs located at a thinned base surface 332 of the outsole component 300 may be less than 25% of the transverse cross sectional area of all of the larger (and optionally siped) projection 204/hole 302 pairs (and in some examples, less than 20%, less than 15%, or even less than 10%) present in the sole structure 104.

A wide variety of numbers and/or arrangements of the smaller protrusion 230/hole 330 pairs are possible in accordance with aspects of this technology. For example, from 2 to 25 total smaller protrusion 230/hole 330 pairs may be provided in a sole structure 104, and for some examples, from 4 to 20, from 5 to 15, or even from 6 to 12 smaller protrusion 230/hole 330 pairs may be provided in a sole structure 104. In the illustrated example: (a) eight (e.g., first through eighth) of the smaller protrusion 230/hole 330 pairs are provided in the forefoot region of the sole structure 104 and (b) two (first and second) of the smaller protrusion 230/hole 330 pairs are provided in the heel region of the sole structure 104. In this illustrated example: (a) four smaller protrusion 230/hole 330 pair are provided between or proximate to the forefoot supporting projection 204/hole 302 pair; (b) four smaller protrusion 230/hole 330 pair are provided between or proximate to the ball of the foot supporting projection 204/hole 302 pair; and (c) two smaller protrusion 230/hole 330 pair are provided between or proximate to the heel supporting projection 204/hole 302 pair. Also, in this illustrated example, the smaller protrusion 230/hole 330 pairs are provided forward and aft from the central arch recess 220 (although a central arch recess 220 need not be present to have one or more of the smaller protrusion 230/hole 330 pairs in these areas). Any desired combination of 2 to 25 smaller protrusion 230/hole 330 pairs may be arranged in any desired areas of the sole structure 104.

As mentioned above, the illustrated sole structure 104 includes ten smaller protrusion 230/hole 330 pairs: (a) four pair in the forefoot supporting region, (b) four pair in the ball of the foot supporting region (e.g., the metatarsal head supporting region), and (c) two pair in the heel supporting region. All of the smaller protrusion 230/hole 330 pairs are cylindrical and circular in cross section (although other shapes are possible). While other options are possible: (a) at least four smaller protrusion 230/hole 330 pair may be located between parallel planes located at 0.65L and 0.95L, and in some examples between parallel planes located at 0.7L and 0.92L (between 0.76L and 0.88L in the illustrated example); (b) at least four smaller protrusion 230/hole 330 pair may be located between parallel planes located at 0.55L and 0.8L, and in some examples between parallel planes located at 0.6L and 0.75L (between 0.64L and 0.71L in the illustrated example); and/or (c) at least two smaller protrusion 230/hole 330 pair may be located between parallel planes located at 0L and 0.2L, and in some examples between parallel planes located at 0.02L and 0.16L (between 0.04L and 0.12L in the illustrated example). While more or fewer smaller protrusion 230/hole 330 pair may be included in any of these parallel plane ranges, some examples of this technology will consist of or consist essentially of ten smaller protrusion 230/hole 330 pairs within the locational ranges described above.

As another potential feature in accordance with some examples of this technology, the outsole component 300 may include one or more protrusions 340 projecting upward from its interior surface 340S (e.g., having any of the cross-sectional shape, size, and/or number features described above for protrusions 230). These protrusion(s) 340 fit into a corresponding one or more holes 240 (e.g., blind holes) defined in the bottom surface 200S and/or base surface 202 of midsole component 200 (e.g., having any of the cross-sectional shape, size, and/or number features described above for holes 330). See FIGS. 2D and 3K-3M. The protrusion 340/hole 240 pairs of this example also are shown in FIGS. 2A and 2E as broken lines (because the structures are hidden by the outsole component 300). While other arrangements and/or numbers of protrusion 340/hole 240 pairs are possible, in this illustrated example, four total protrusion 340/hole 240 pairs (e.g., first through fourth pairs) are provided. Two of the protrusion 340/hole 240 pairs are located on a lateral side of the sole structure 104 (e.g., in the arch support area, in a lateral side region of the midsole component 200's base surface 202, located adjacent the lateral side ridge 210L, and/or located along and/or adjacent a lateral side of the central arch recess 220, etc.). Similarly, in this example, two protrusion 340/hole 240 pairs are located on a medial side of the sole structure 104 (e.g., in the arch support area, in a medial side region of the midsole component 200's base surface 202, located adjacent the medial side ridge 210M, and/or located along and/or adjacent a medial side of the central arch recess 220, etc.). The protrusion 340/hole 240 pair(s) can help maintain a stable connection between the midsole component 200 and outsole component 300, e.g., in the arch region of the sole structure 104.

As mentioned above, the illustrated sole structure 104 includes four smaller protrusion 340/hole 240 pairs: (a) two in the lateral side region (e.g., in the arch support area) and (b) two in the medial side region (e.g., in the arch support area). While other options are possible, one or more of these four smaller protrusion 340/hole 240 pairs may be located between parallel planes located at 0.25L and 0.65L, and in some examples between parallel planes located at 0.27L and 0.6L (all four located between 0.3L and 0.53L in the illustrated example). While more or fewer smaller protrusion 340/hole 240 pair may be included in any of these parallel plane ranges (or other locations), some examples of this technology will consist of or consist essentially of four smaller protrusion 340/hole 240 pairs within the locational ranges described above.

Sole structures 104 in accordance with at least some examples of this technology may include a front tab 350F and a rear tab 350R (e.g., provided as part of the outsole component 300). These tabs 350F and/or 350R wrap upward around the sole structure 104 to engage with another part of the sole structure 104 (e.g., the midsole component 200) and/or the upper 102. This engagement may be a permanent engagement (e.g., using adhesives or cements) or a removable engagement (e.g., using hook-and-loop fasteners, using retaining elements, using stretch or friction fit, etc.). FIGS. 2B, 2C, 3A, 3C-3F, and 3J show a portion 352 of a hook-and-loop fastener attached to each of the tabs 350F, 350R. The tabs 350F, 350R, together with their hook-and-loop fastener portion 352, can be wrapped upward to engage a corresponding portion of a hook-and-loop provided on the midsole component 200 and/or upper 102 (not shown) and thereby provide releasable attachment of the tabs 350F, 350R to the midsole component 200 and/or upper 102. The hook-and-loop fastener portion 352 may be engaged with its respective tab 350F, 350R in any desired manner, such as by adhesives, by stitching, etc.

These releasable tab(s) 350F, 350R, e.g., in combination with one or more of the projection 204/hole 302 pair(s), the smaller protrusion 230/hole 330 pairs, the smaller protrusion 340/hole 240 pairs, and/or the raised ridge or raised surface 222/opening 320 pair, permit removable attachment between the midsole component 200 and outsole component 300 of this example. These releasable tab(s) 350F, 350R in combination with releasable connection of the upper 102 to the midsole component 200 via components 120 discussed above also permit removable attachment between the sole structure 104 and upper 102 in this example footwear structure 100. One or more of these types of removable engagement mechanisms may be omitted from a footwear structure 100 and/or sole structure 104 in some examples of this technology. In other words, not all of these releasable engagement components are needed in all examples of this technology. Rather, footwear 100 and sole structures 104 may include removable engagement features with any one or more of these releasable and removable attachment systems.

As evident from the description above, when formed to be removably engaged with a midsole component 200, the outsole component 300 may be rather flexible or pliable. This feature enables movement and stretch of the outsole component 300's holes 302 or opening 320 over their corresponding mating components on midsole 200 and enables the tabs 350F, 350R to be wrapped upward around the midsole component 200 and/or upper 102. Thus, the outsole component 300 can be formed (e.g., molded, pressed, etc.) in a generally flat form, e.g., as shown in FIGS. 3A-3C, 3E, 3G, 3I, 3K, and 3L. This feature can simplify manufacture, reduce tooling costs, and/or reduce needed part storage area. FIGS. 3D, 3F, 3H, and 3J correspond to FIGS. 3C, 3E, 3G, and 3I, respectively, but show the outsole component 300 wrapped around and engaged with midsole component 200. FIGS. 3K and 3L show the outsole component 300 (top and bottom surfaces) as a separate part from the midsole component 200 (the bottom surface of which is shown in FIG. 3M).

This type of removable engagement, when used, is advantageous because it allows individual replacement of parts (e.g., upper 102, midsole component 200, and/or outsole component 300) and/or separation of parts (e.g., upper 102, midsole component 200, and/or outsole component 300) for potential recycling purposes. Additionally or alternatively, this type of removable engagement, when used, is advantageous because it allows the user to swap out the individual parts for other parts, e.g., depending on the activity to be conducted. More specifically, different uppers 102, midsole components 200, outsole components 300, and/or combinations thereof may be used for different activities, e.g., to provide better traction, better support, and/or other desired characteristics for the specific activity. Additionally or alternatively, different uppers 102, midsole components 200, outsole components 300, and/or combinations thereof may be used based on a user's preferences at a specific time (e.g., for different colors and/or color combinations, etc.).

As described above, the free end surfaces 204S of one or more of the projections 204 may include one or more sipes 206 (e.g., a pair of intersecting sipes) extending into the projection 204 main body 204B. This is shown, for example, in FIGS. 2A, 2D, 2E, 3B, 3G-3J, 3M, 4C-4F, 4J, and 4K.

Figure 4A:
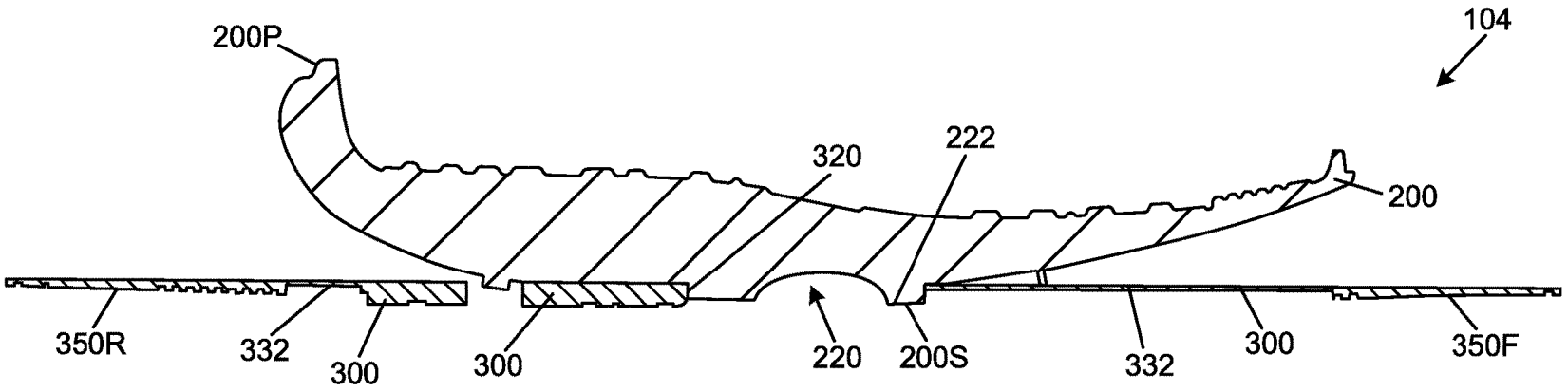
FIGS. 4A-4K provide cross sectional views taken along corresponding section lines shown in FIG. 3B.
Figure 4C:
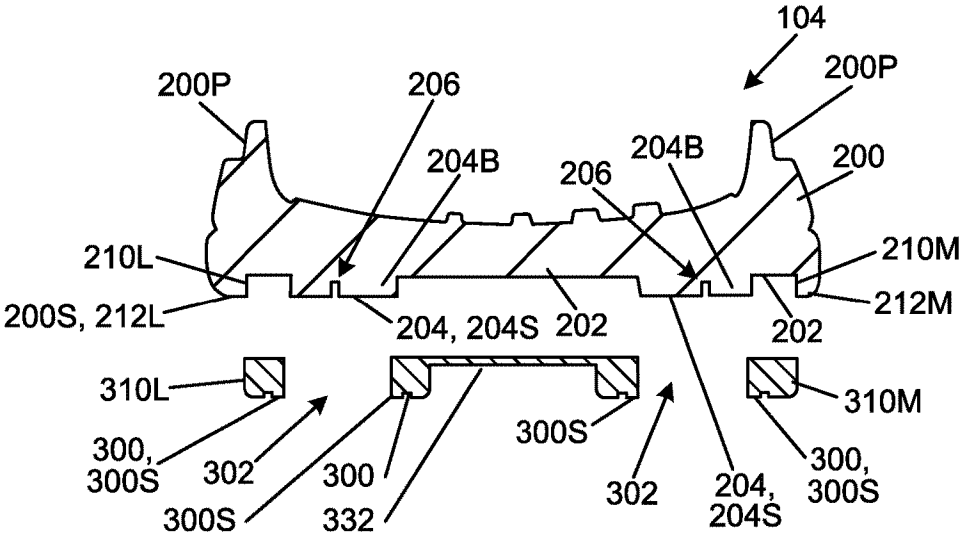
Figure 4B:
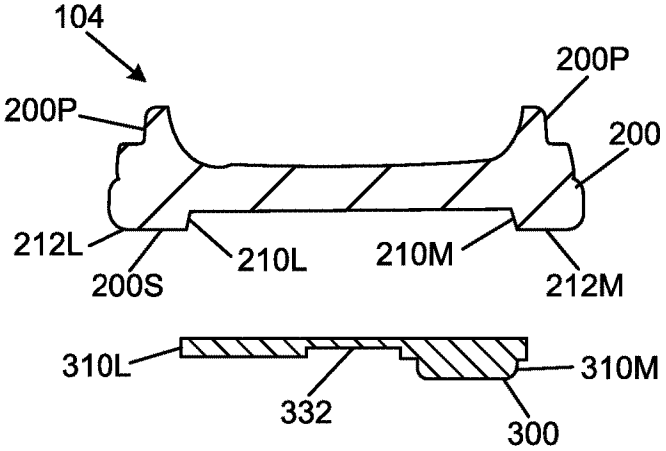
Figure 4D:
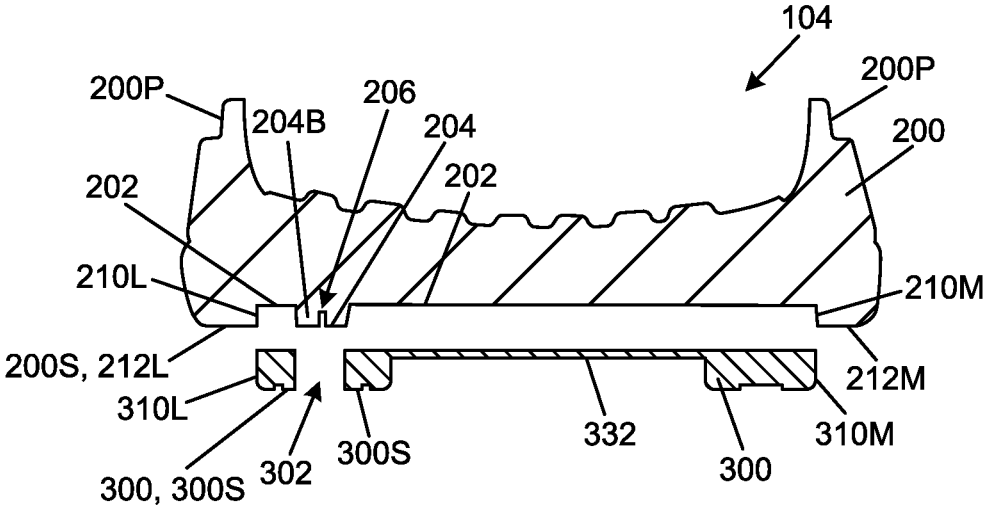
Figure 4E:
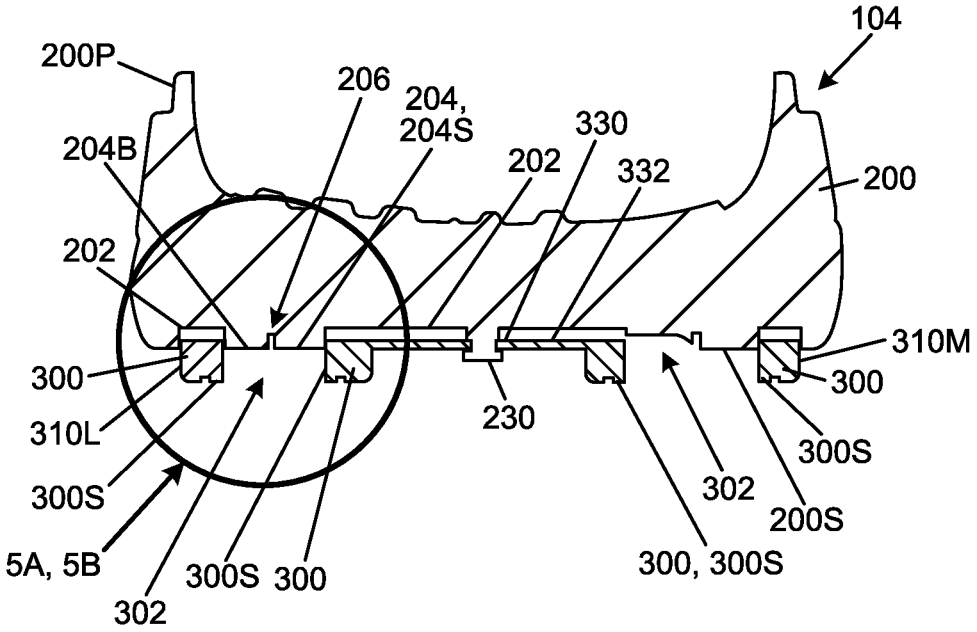
Figure 4F:
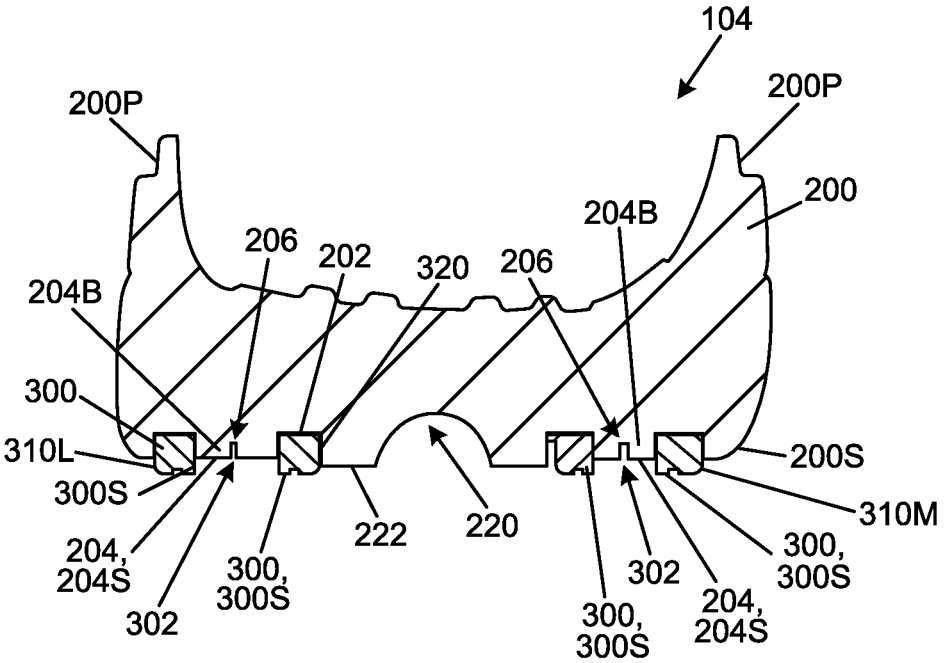
Figure 4G:
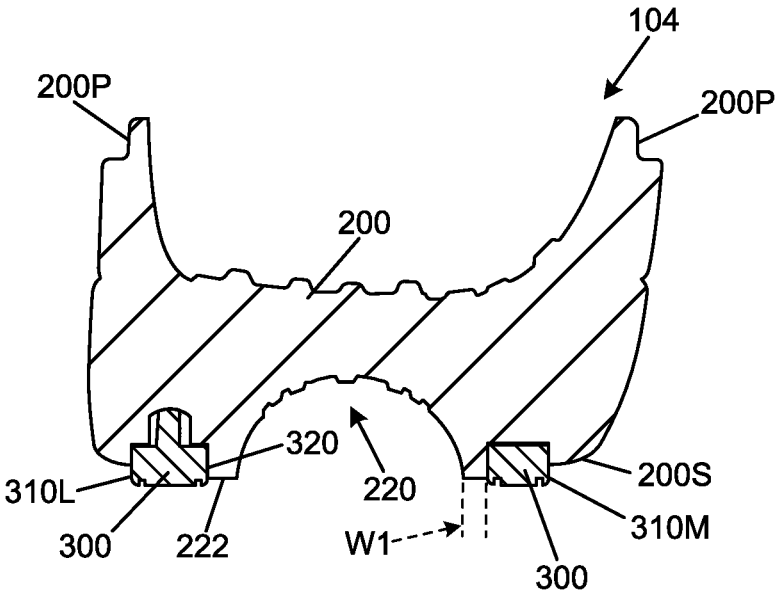
Figure 4H:
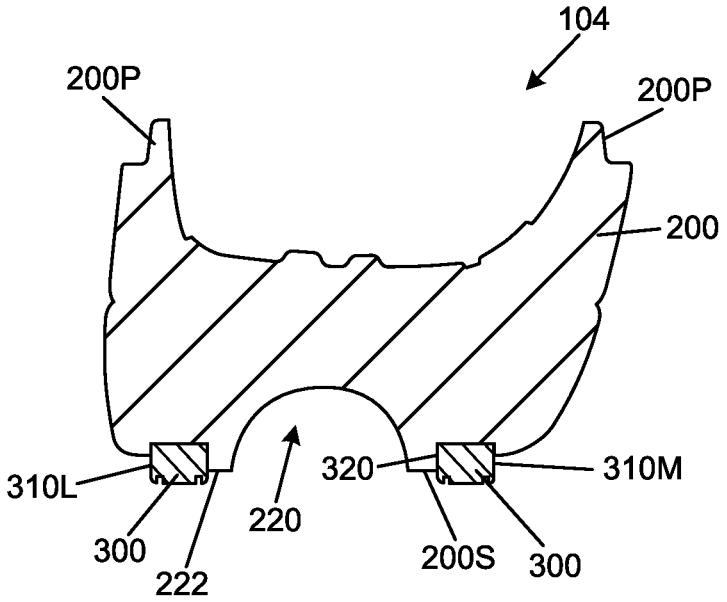
Figure 4I:
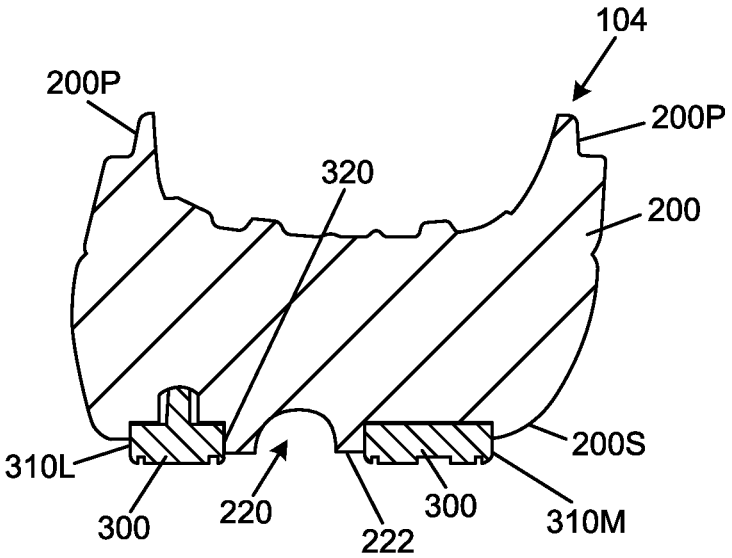
Figure 4J:
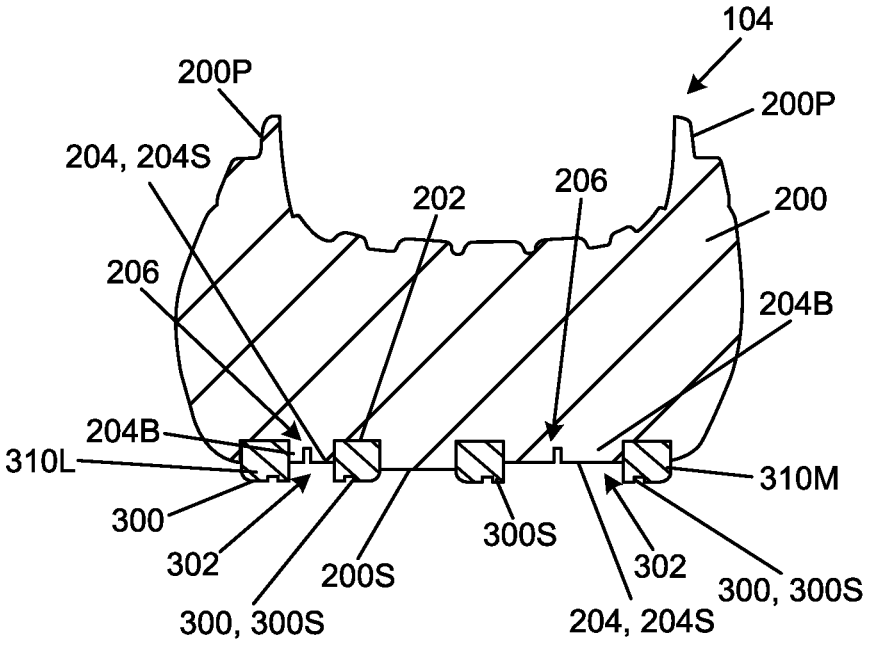
Figure 4K:
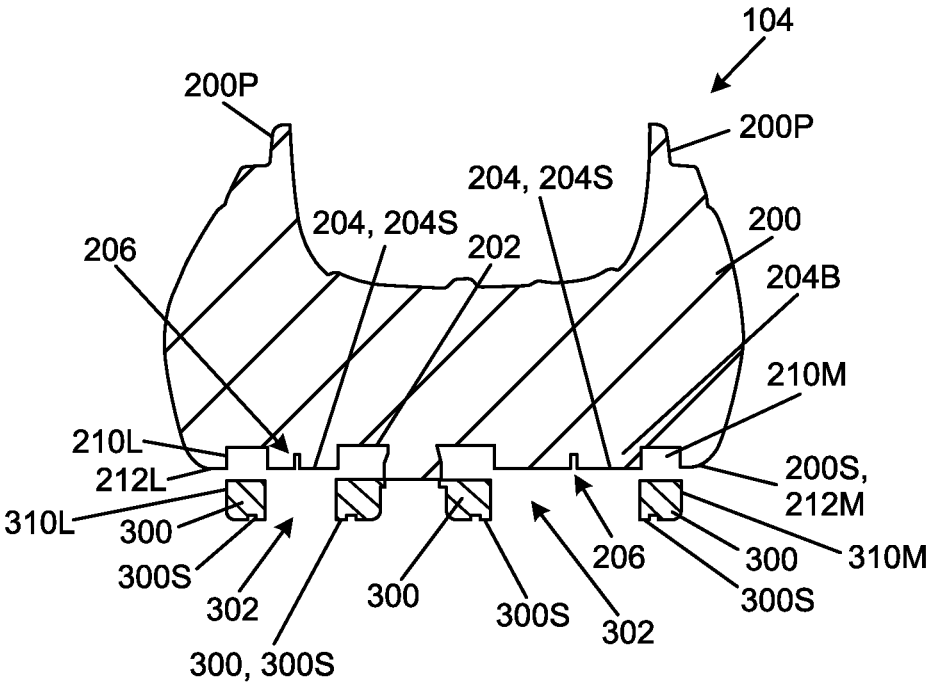
Figure 5A:
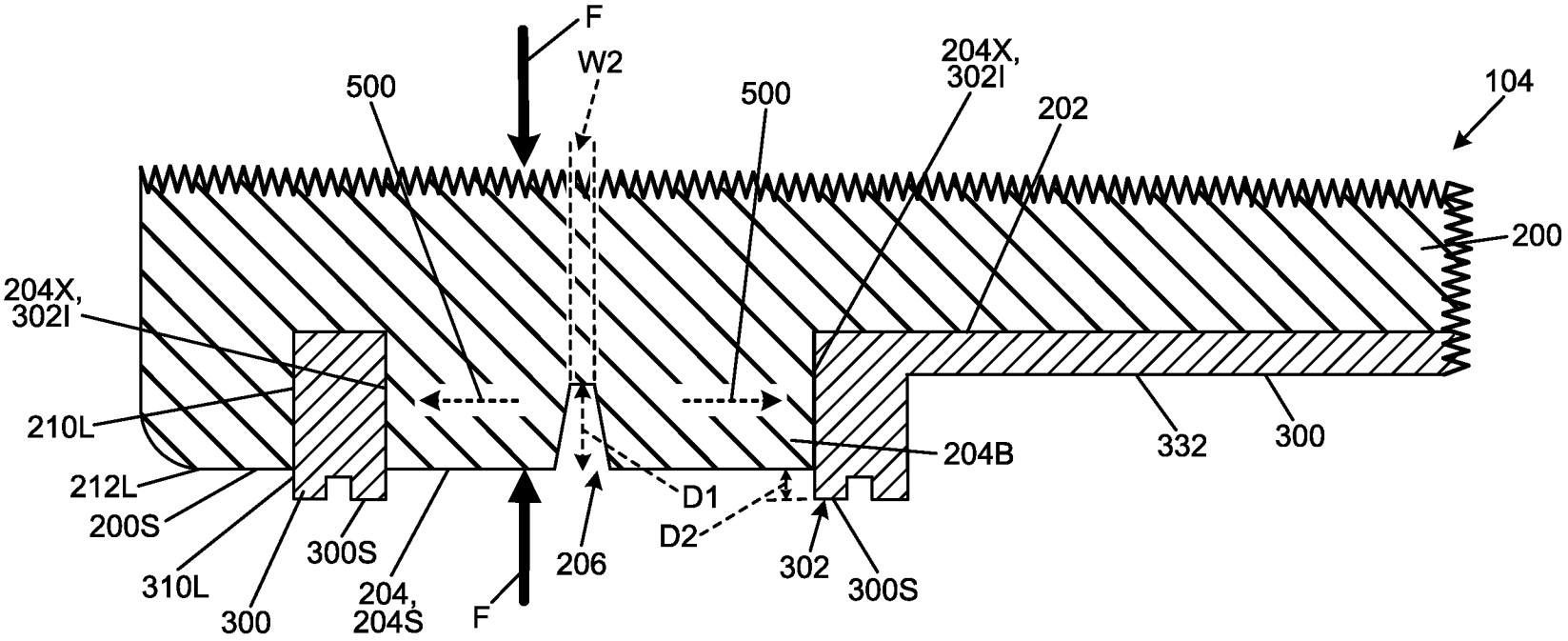
FIGS. 5A and 5B provide an enlarged view of area 5A, 5B shown in FIG. 4E to illustrate specific features of sole structures in accordance with some examples of this technology.
Figure 5B:
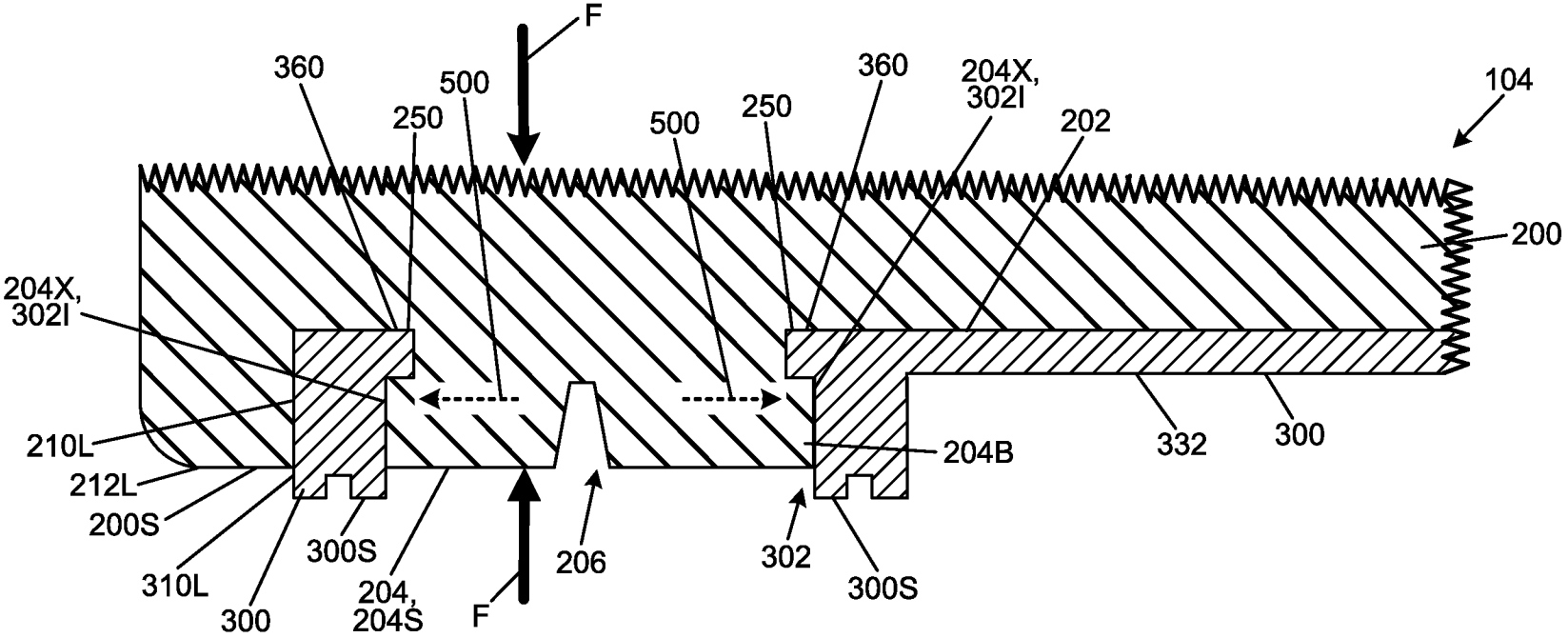

FIGS. 5A and 5B are enlarged views taken from the area shown in circle 5A, 5B in FIG. 4E. While not wishing to be bound by any particular theory of operation, these sipes 206 may help hold the outsole component 300 to the midsole component 200 in use. As shown in FIG. 5A, under an adequate applied force F at the projection 204 (e.g., from foot contact with the ground), the sipes 206 may allow the quadrants of the projections 204 to splay outward from the sipe 206 intersection toward the surrounding walls of the outsole component 300 defining the hole 302. See splay direction arrows 500 in FIGS. 2A and 5A. This outwardly directed splay force (from the sipe 206 intersection) applies added force between the exterior surface 204X of the projection 204 and the interior surface 3021 of the outsole component 300 defining the hole 302 to more securely hold these parts in place (e.g., more securely seat the projection 204 in the outsole component 300's hole 302).

The sipe(s) 206 (e.g., formed as cuts by a knife, by a hot knife, by laser; formed by molding; etc.) may have any desired depth dimension D1 into the free end surface 204S. In accordance with some aspects of this technology, the depth dimension D1 for the sipes 206 (when no external force is applied to the sole member 104, e.g., by a wearer's weight) may be within the range of 1 mm to 25 mm, 1.5 mm to 20 mm, 2 mm to 16 mm, 2 mm to 12 mm, 1 mm to 8 mm, and in some examples, from 1.5 mm to 6 mm or even from 2 mm to 6 mm. Additionally or alternatively, in some examples of this technology, the sipe depth D1 may be at least 20% of an overall height dimension of its projection 204 (e.g., the height dimension from base surface 202 to free end surface 204S), and in some examples, at least 25%, at least 40%, at least 50%, at least 60%, at least 75%, or even at least 90% of an overall height dimension. Some sole structure 104 examples according to this technology will have a sipe configuration(s) and/or sipe depth dimension(s) sufficient to provide the splay effect described above. The sipe width W2 in an unsplayed configuration (e.g., when no external force is applied to the sole member 104, e.g., by a wearer's weight) may be from 0 to 3 mm, and in some examples, from 0 to 2 mm.

FIG. 5B illustrates an alternative structure to that shown in FIG. 5A. In the example of FIG. 5B, the projection 204 of midsole component 200 is formed such that its sidewall includes one or more indentations 250 in its exterior surface 204X. The interior surface 3021 of the outsole component 300 forming the hole 302 in this example is formed to include one or more ridges 360 that extend into the corresponding indentation(s) 250 in the midsole component 200. In addition to the securing functions performed by interaction of the ridge(s) 360 with the indentation(s) 250, the splaying forces 500 described above in conjunction with FIG. 5A will further push the ridge(s) 360 into the indentation(s) 250. Additionally or alternatively, if desired, one or more indentation(s) 250 may be provided on the interior surface 3021 of the outsole component 300 forming the hole 302 and corresponding projection(s) 360 may be provided on the exterior surface 204X of the outsole component 200's projection 204.

As another additional or alternative potential feature in accordance with at least some examples of this technology, one or more sipes 224 may be formed in the exposed surface of the central arch recess 220 (extending upward into the material of the midsole component 200). Such sipes 224 are shown as broken lines in FIG. 2A and as sipes 224 forming one or more intersections. Sipes 224 of this type can help the regions of the central arch recess 220 splay outward in a similar manner as described above in conjunction with FIGS. 5A and 5B. This outward splay can help engage the outer surface of raised ridge or raised surface 222 with the interior surface of the outsole component 300 at the area defining central arch opening 320. While other patterns and/or numbers of sipes 224 are possible, FIG. 2A shows a central longitudinal sipe 224 intersected by two transverse sipes 224. As other options, however, two or more sipes 224 could be arranged in a diagonal arrangement across central arch recess 220, more or fewer sipes 224 could be provided, etc.

Additionally or alternatively, if desired: (a) the raised ridge or raised surface 222 of the central arch recess 220 may include one or more indentations (e.g., like those described above as reference number 250 in conjunction with FIGS. 5A and 5B) and (b) the interior surface of outsole component 300 forming the central arch opening 320 may include one or more ridges (e.g., like those described above as reference number 360 in conjunction with FIGS. 5A and 5B) that engage the corresponding indentation(s). Still additionally or alternatively, if desired: (a) the raised ridge or raised surface 222 of the central arch recess 220 may include one or more ridges (e.g., like those described above as reference number 360 in conjunction with FIGS. 5A and 5B) and (b) the interior surface of outsole component 300 forming the central arch opening 320 may include one or more indentations (e.g., like those described above as reference number 250 in conjunction with FIGS. 5A and 5B) that engage the corresponding ridge(s). The indentation/ridge pair(s), when present, can help hold the midsole component 200 and outsole component 300 together at the arch region, e.g., as described above.

III. Conclusion

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A sole structure for an article of footwear, comprising:

(a) a midsole component having a bottom surface, wherein the bottom surface includes: (i) a base surface and (ii) a first projection including a first body extending away from the base surface, wherein a first exposed free end surface of the first projection includes a first pair of intersecting sipes extending inward into the first body; and (b) an outsole component removably engaged with the midsole component, wherein the outsole component includes a first hole defined therein, wherein the first projection extends into the first hole, and wherein the first exposed free end surface of the first projection is exposed through the first hole and recessed inward from an exposed exterior surface of the outsole component immediately adjacent the first hole.

Clause 2. The sole structure according to Clause 1, wherein the bottom surface of the midsole component further includes: (i) a second projection including a second body extending away from the base surface, wherein a second exposed free end surface of the second projection includes a second pair of intersecting sipes extending inward into the second body; and wherein the outsole component further includes a second hole defined therein, wherein the second projection extends into the second hole, and wherein the second exposed free end surface of the second projection is exposed through the second hole and recessed inward from the exposed exterior surface of the outsole component immediately adjacent the second hole.

Clause 3. The sole structure according to Clause 2, wherein the first projection and the first hole are located in a forefoot region of the sole structure and the second projection and the second hole are located in a heel region of the sole structure.

Clause 4. The sole structure according to Clause 2, wherein the first projection and the first hole are located in a forefoot region of the sole structure and the second projection and the second hole are located in the forefoot region of the sole structure.

Clause 5. The sole structure according to Clause 2, wherein the first projection and the first hole are located in a heel region of the sole structure and the second projection and the second hole are located in the heel region of the sole structure.

Clause 6. The sole structure according to Clause 2, wherein the first projection and the first hole are located forward of the second projection and the second hole in the sole structure.

Clause 7. The sole structure according to Clause 2, wherein the first projection and the first hole are located on a lateral side of the sole structure and the second projection and the second hole are located on a medial side of the sole structure.

Clause 8. The sole structure according to Clause 2, wherein each of the first projection, the first hole, the second projection, and the second hole are located on one of a lateral side or a medial side of the sole structure.

Clause 9. The sole structure according to Clause 2, wherein the bottom surface of the midsole component further includes a third projection including a third body extending away from the base surface, wherein a third exposed free end surface of the third projection includes a third pair of intersecting sipes extending inward into the third body; and wherein the outsole component further includes a third hole defined therein, wherein the third projection extends into the third hole, and wherein the third exposed free end surface of the third projection is exposed through the third hole and recessed inward from the exposed exterior surface of the outsole component immediately adjacent the third hole.

Clause 10. The sole structure according to Clause 9, wherein the bottom surface of the midsole component further includes: (i) a fourth projection including a fourth body extending away from the base surface, wherein a fourth exposed free end surface of the fourth projection includes a fourth pair of intersecting sipes extending inward into the fourth body; and wherein the outsole component further includes a fourth hole defined therein, wherein the fourth projection extends into the fourth hole, and wherein the fourth exposed free end surface of the fourth projection is exposed through the fourth hole and recessed inward from the exposed exterior surface of the outsole component immediately adjacent the fourth hole.

Clause 11. The sole structure according to Clause 10, wherein the bottom surface of the midsole component further includes a fifth projection including a fifth body extending away from the base surface, wherein a fifth exposed free end surface of the fifth projection includes a fifth pair of intersecting sipes extending inward into the fifth body; and wherein the outsole component further includes a fifth hole defined therein, wherein the fifth projection extends into the fifth hole, and wherein the fifth exposed free end surface of the fifth projection is exposed through the fifth hole and recessed inward from the exposed exterior surface of the outsole component immediately adjacent the fifth hole.

Clause 12. The sole structure according to Clause 11, wherein the bottom surface of the midsole component further includes a sixth projection including a sixth body extending away from the base surface, wherein a sixth exposed free end surface of the sixth projection includes a sixth pair of intersecting sipes extending inward into the sixth body; and wherein the outsole component further includes a sixth hole defined therein, wherein the sixth projection extends into the sixth hole, and wherein the sixth exposed free end surface of the sixth projection is exposed through the sixth hole and recessed inward from the exposed exterior surface of the outsole component immediately adjacent the sixth hole.

Clause 13. The sole structure according to Clause 12, wherein: (a) the first projection and the first hole are located at a lateral forefoot region of the sole structure, (b) the second projection and the second hole are located at a medial forefoot region of the sole structure, (c) the third projection and the third hole are located at the lateral forefoot region and/or a lateral midfoot region of the sole structure rearward of the first projection and the first hole, (d) the fourth projection and the fourth hole are located at the medial forefoot region and/or a medial midfoot region of the sole structure rearward of the second projection and the second hole, (e) the fifth projection and the fifth hole are located at a lateral heel region of the sole structure, and (f) the sixth projection and the sixth hole are located at a medial heel region of the sole structure.

Clause 14. The sole structure according to Clause 1, wherein the bottom surface of the midsole component further includes: (i) a lateral side ridge extending away from the base surface, wherein a lateral side portion of the midsole component outside the lateral side ridge defines at least a portion of a lateral side bottom perimeter surface of the sole structure, and (ii) a medial side ridge extending away from the base surface, wherein a medial side portion of the midsole component outside the medial side ridge defines at least a portion of a medial side bottom perimeter surface of the sole structure, wherein at least a portion of an outermost exterior lateral edge of the outsole component is located inside the lateral side ridge, and wherein at least a portion of an outermost exterior medial edge of the outsole component is located inside the medial side ridge.

Clause 15. The sole structure according to Clause 1 or 14, wherein the bottom surface of the midsole component further includes: (i) a first protrusion extending outward from the base surface, wherein the first protrusion has a transverse cross sectional area of less than 200 $mm^2$, and (ii) a second hole extending inward from the base surface, wherein the second hole defines a transverse cross sectional area of less than 200 $mm^2$; and wherein the outsole component further includes: (i) an interior surface, (ii) a second protrusion extending from the interior surface and into the second hole of the midsole component, and (iii) a third hole defined in the interior surface and receiving the first protrusion of the midsole component.

Clause 16. The sole structure according to Clause 1 or 14, wherein the bottom surface of the midsole component further includes: (i) a second hole extending inward from the base surface, wherein the second hole defines a transverse cross sectional area of less than 200 $mm^2$, and (iii) a third hole extending inward from the base surface, wherein the third hole defines a transverse cross sectional area of less than 200 $mm^2$; and wherein the outsole component further includes: (i) an interior surface, (ii) a first protrusion extending from the interior surface and into the second hole of the midsole component, and (iii) a second protrusion extending from the interior surface and into the third hole of the midsole component.

Clause 17. The sole structure according to Clause 1 or 14, wherein the bottom surface of the midsole component further includes: (i) a first protrusion extending outward from the base surface, wherein the first protrusion has a transverse cross sectional area of less than 200 $mm^2$, (ii) a second protrusion extending outward from the base surface, wherein the second protrusion has a transverse cross sectional area of less than 200 $mm^2$, (iii) a second hole extending inward from the base surface, wherein the second hole defines a transverse cross sectional area of less than 200 $mm^2$, and (v) a third hole extending inward from the base surface, wherein the third hole defines a transverse cross sectional area of less than 200 $mm^2$; and wherein the outsole component further includes: (i) an interior surface, (ii) a third protrusion extending from the interior surface and into the second hole of the midsole component, (iii) a fourth protrusion extending from the interior surface and into the third hole of the midsole component, (iv) a fourth hole defined in the interior surface and receiving the first protrusion of the midsole component, and (v) a fifth hole defined in the interior surface and receiving the second protrusion of the midsole component.

Clause 18. The sole structure according to Clause 1 or 14, wherein the base surface of the midsole component includes a lateral side region and a medial side region, wherein the bottom surface of the midsole component further includes: (i) a central arch recess extending inward from the base surface and located between the lateral side region and the medial side region, and (ii) a first hole located adjacent the central arch recess and extending inward from the base surface at one of the lateral side region or the medial side region, wherein the first hole defines a third transverse cross sectional area of less than 200 $mm^2$; and wherein the outsole component further includes: (i) an interior surface, (ii) a first opening through which the central arch recess is exposed at a bottom of the sole structure, and (iii) a first protrusion extending from the interior surface and into the first hole of the midsole component.

Clause 19. The sole structure according to any one of Clauses 1 to 17, wherein the base surface of the midsole component includes a lateral side region and a medial side region, wherein the bottom surface of the midsole component further includes a central arch recess extending inward from the base surface and located between the lateral side region and the medial side region, and wherein the outsole component further includes a first opening through which the central arch recess is exposed at a bottom of the sole structure.

Clause 20. A sole structure for an article of footwear, comprising:

(a) a midsole component having a bottom surface, wherein the bottom surface includes: (i) a base surface, (ii) a lateral side ridge extending away from the base surface, wherein a lateral side portion of the midsole component outside the lateral side ridge defines at least a portion of a lateral side bottom perimeter surface of the sole structure, and (iii) a medial side ridge extending away from the base surface, wherein a medial side portion of the midsole component outside the medial side ridge defines at least a portion of a medial side bottom perimeter surface of the sole structure; and (b) an outsole component removably engaged with the midsole component, wherein at least a portion of an outermost exterior lateral edge of the outsole component is located inside the lateral side ridge, and wherein at least a portion of an outermost exterior medial edge of the outsole component is located inside the medial side ridge.

Clause 21. The sole structure according to Clause 20, wherein the bottom surface of the midsole component further includes: (i) a first protrusion extending outward from the base surface, wherein the first protrusion has a transverse cross sectional area of less than 200 $mm^2$, and (ii) a first hole extending inward from the base surface, wherein the first hole defines a transverse cross sectional area of less than 200 $mm^2$; and wherein the outsole component further includes: (i) an interior surface, (ii) a second protrusion extending from the interior surface and into the first hole of the midsole component, and (iii) a second hole defined in the interior surface and receiving the first protrusion of the midsole component.

Clause 22. The sole structure according to Clause 20, wherein the bottom surface of the midsole component further includes: (i) a first hole extending inward from the base surface, wherein the first hole defines a transverse cross sectional area of less than 200 $mm^2$, and (ii) a second hole extending inward from the base surface, wherein the second hole defines a transverse cross sectional area of less than 200 $mm^2$; and wherein the outsole component further includes: (i) an interior surface, (ii) a first protrusion extending from the interior surface and into the first hole of the midsole component, and (iii) a second protrusion extending from the interior surface and into the second hole of the midsole component.

Clause 23. The sole structure according to Clause 22, wherein the first hole is located adjacent the lateral side ridge, and wherein the second hole is located adjacent the lateral side ridge.

Clause 24. The sole structure according to Clause 22, wherein the first hole is located adjacent the lateral side ridge, and wherein the second hole is located adjacent the medial side ridge.

Clause 25. The sole structure according to Clause 22, wherein the first hole is located adjacent the medial side ridge, and wherein the second hole is located adjacent the medial side ridge.

Clause 26. The sole structure according to Clause 20, wherein the bottom surface of the midsole component further includes: (i) a first protrusion extending outward from the base surface, wherein the first protrusion has a transverse cross sectional area of less than 200 $mm^2$, (ii) a second protrusion extending outward from the base surface, wherein the second protrusion has a transverse cross sectional area of less than 200 $mm^2$, (iii) a first hole extending inward from the base surface, wherein the first hole defines a transverse cross sectional area of less than 200 $mm^2$, and (iv) a second hole extending inward from the base surface, wherein the second hole defines a transverse cross sectional area of less than 200 $mm^2$; and wherein the outsole component further includes: (i) an interior surface, (ii) a third protrusion extending from the interior surface and into the first hole of the midsole component, (iii) a fourth protrusion extending from the interior surface and into the second hole of the midsole component, (iv) a third hole defined in the interior surface and receiving the first protrusion of the midsole component, and (v) a fourth hole defined in the interior surface and receiving the second protrusion of the midsole component.

Clause 27. The sole structure according to any one of Clauses 20 to 26, wherein the bottom surface of the midsole component further includes a central arch recess extending inward from the base surface and located between the lateral side ridge and the medial side ridge, and wherein the outsole component further includes a first opening through which the central arch recess is exposed at a bottom of the sole structure.

Clause 28. A sole structure for an article of footwear, comprising:

(a) a midsole component having a bottom surface, wherein the bottom surface includes: (i) a base surface, (ii) a first protrusion extending outward from the base surface, wherein the first protrusion has a transverse cross sectional area of less than 200 $mm^2$, and (iii) a first hole extending inward from the base surface, wherein the first hole defines a transverse cross sectional area of less than 200 $mm^2$; and (b) an outsole component removably engaged with the midsole component, wherein the outsole component includes: (i) an interior surface, (ii) a second protrusion extending from the interior surface and into the first hole of the midsole component, and (iii) a second hole defined in the interior surface and receiving the first protrusion of the midsole component.

Clause 29. The sole structure according to Clause 28, wherein the first hole is located in the base surface at a lateral side of the sole structure in an arch support region of the sole structure.

Clause 30. The sole structure according to Clause 28, wherein the first hole is located in the base surface at a medial side of the sole structure in an arch support region of the sole structure.

Clause 31. The sole structure according to any one of Clauses 28 to 30, wherein the bottom surface of the midsole component further includes a third hole that defines a transverse cross sectional area of less than 200 $mm^2$, and wherein the outsole component further includes a third protrusion extending from the interior surface and into the third hole of the midsole component.

Clause 32. The sole structure according to Clause 31, wherein the third hole is located in the base surface at a lateral side of the sole structure in an arch support region of the sole structure.

Clause 33. The sole structure according to Clause 31, wherein the third hole is located in the base surface at a medial side of the sole structure in an arch support region of the sole structure.

Clause 34. The sole structure according to any one of Clauses 28 to 33, wherein the bottom surface of the midsole component further includes a central arch recess extending inward from the base surface and located between a lateral side region and a medial side region of the sole structure, and wherein the outsole component further includes a first opening through which the central arch recess is exposed at a bottom of the sole structure.

Clause 35. A sole structure for an article of footwear, comprising:

(a) a midsole component having a bottom surface, wherein the bottom surface includes: (i) a base surface, (ii) a first hole extending inward from the base surface, wherein the first hole defines a transverse cross sectional area of less than 200 $mm^2$, and (iii) a second hole extending inward from the base surface, wherein the second hole defines a transverse cross sectional area of less than 200 $mm^2$; and (b) an outsole component removably engaged with the midsole component, wherein the outsole component includes: (i) an interior surface, (ii) a first protrusion extending from the interior surface and into the first hole of the midsole component, and (iii) a second protrusion extending from the interior surface and into the second hole of the midsole component.

Clause 36. The sole structure according to Clause 35, wherein the first hole is located at a lateral side of the sole structure in an arch support region of the sole structure.

Clause 37. The sole structure according to Clause 36, wherein the second hole is located at the lateral side of the sole structure in the arch support region of the sole structure.

Clause 38. The sole structure according to Clause 36, wherein the second hole is located at a medial side of the sole structure in the arch support region of the sole structure.

Clause 39. The sole structure according to Clause 35, wherein the first hole is located at a medial side of the sole structure in an arch support region of the sole structure.

Clause 40. The sole structure according to Clause 39, wherein the second hole is located at the medial side of the sole structure in the arch support region of the sole structure.

Clause 41. The sole structure according to any one of Clauses 35 to 40, wherein the bottom surface of the midsole component further includes a third hole extending inward from the base surface, wherein the third hole defines a transverse cross sectional area of less than 200 $mm^2$, and wherein the outsole component further includes a third protrusion extending from the interior surface and into the third hole of the midsole component.

Clause 42. The sole structure according to Clause 41, wherein the bottom surface of the midsole component further includes a fourth hole extending inward from the base surface, wherein the fourth hole defines a transverse cross sectional area of less than 200 $mm^2$, and wherein the outsole component further includes a fourth protrusion extending from the interior surface and into the fourth hole of the midsole component.

Clause 43. The sole structure according to Clause 42, wherein the fourth hole is located in an arch support region of the sole structure.

Clause 44. The sole structure according to any one of Clauses 41 to 43, wherein the third hole is located in an arch support region of the sole structure.

Clause 45. The sole structure according to any one of Clauses 41 to 44, wherein the bottom surface of the midsole component further includes a central arch recess extending inward from the base surface and located between a lateral side region and a medial side region of the sole structure, and wherein the outsole component further includes a first opening through which the central arch recess is exposed at a bottom of the sole structure.

Clause 46. A sole structure for an article of footwear, comprising:

(a) a midsole component having a bottom surface, wherein the bottom surface includes: (i) a base surface, (ii) a first protrusion extending outward from the base surface, wherein the first protrusion has a transverse cross sectional area of less than 200 $mm^2$, (iii) a second protrusion extending outward from the base surface, wherein the second protrusion has a transverse cross sectional area of less than 200 $mm^2$, (iv) a first hole extending inward from the base surface, wherein the first hole defines a transverse cross sectional area of less than 200 $mm^2$, and (v) a second hole extending inward from the base surface, wherein the second hole defines a transverse cross sectional area of less than 200 $mm^2$; and (b) an outsole component removably engaged with the midsole component, wherein the outsole component includes: (i) an interior surface, (ii) a third protrusion extending from the interior surface and into the first hole of the midsole component, (iii) a fourth protrusion extending from the interior surface and into the second hole of the midsole component, (iv) a third hole defined in the interior surface and receiving the first protrusion of the midsole component, and (v) a fourth hole defined in the interior surface and receiving the second protrusion of the midsole component.

Clause 47. The sole structure according to Clause 46, wherein the first hole is located at a lateral side of the sole structure in an arch support region of the sole structure.

Clause 48. The sole structure according to Clause 47, wherein the second hole is located at the lateral side of the sole structure in the arch support region of the sole structure.

Clause 49. The sole structure according to Clause 47, wherein the second hole is located at a medial side of the sole structure in the arch support region of the sole structure.

Clause 50. The sole structure according to Clause 46, wherein the first hole is located at a medial side of the sole structure in an arch support region of the sole structure.

Clause 51. The sole structure according to Clause 50, wherein the second hole is located at the medial side of the sole structure in the arch support region of the sole structure.

Clause 52. The sole structure according to any one of Clauses 46 to 51, wherein the bottom surface of the midsole component further includes a fifth hole extending inward from the base surface, wherein the fifth hole defines a transverse cross sectional area of less than 200 $mm^2$, and wherein the outsole component further includes a fifth protrusion extending from the interior surface and into the fifth hole of the midsole component.

Clause 53. The sole structure according to Clause 52, wherein the bottom surface of the midsole component further includes a sixth hole extending inward from the base surface, wherein the sixth hole defines a transverse cross sectional area of less than 200 $mm^2$, and wherein the outsole component further includes a sixth protrusion extending from the interior surface and into the sixth hole of the midsole component.

Clause 54. The sole structure according to Clause 53, wherein the sixth hole is located in an arch support region of the sole structure.

Clause 55. The sole structure according to any one of Clauses 52 to 54, wherein the fifth hole is located in an arch support region of the sole structure.

Clause 56. The sole structure according to any one of Clauses 46 to 55, wherein the bottom surface of the midsole component further includes a central arch recess extending inward from the base surface and located between a lateral side region and a medial side region of the sole structure, and wherein the outsole component further includes a first opening through which the central arch recess is exposed at a bottom of the sole structure.

Clause 57. A sole structure for an article of footwear, comprising:

(a) a midsole component having a bottom surface, wherein the bottom surface includes: (i) a base surface including a lateral side region and a medial side region, (ii) a central arch recess extending inward from the base surface and located between the lateral side region and the medial side region, and (iii) a first hole located adjacent the central arch recess and extending inward from the base surface at one of the lateral side region or the medial side region, wherein the first hole defines a transverse cross sectional area of less than 200 $mm^2$; and (b) an outsole component removably engaged with the midsole component, wherein the outsole component includes: (i) an interior surface, (ii) a first opening through which the central arch recess is exposed at a bottom of the sole structure, and (iii) a first protrusion extending from the interior surface and into the first hole of the midsole component.

Clause 58. The sole structure according to Clause 57, wherein the bottom surface of the midsole component further includes a first projection including a first body extending away from the base surface, wherein a first exposed free end surface of the first projection includes a first pair of intersecting sipes extending inward into the first body; and wherein the outsole component further includes a second hole defined therein, wherein the first projection extends into the second hole.

Clause 59. The sole structure according to Clause 58, wherein the bottom surface of the midsole component further includes a second projection including a second body extending away from the base surface, wherein a second exposed free end surface of the second projection includes a second pair of intersecting sipes extending inward into the second body; and wherein the outsole component further includes a third hole defined therein, wherein the second projection extends into the third hole.

Clause 60. The sole structure according to Clause 59, wherein the bottom surface of the midsole component further includes a third projection including a third body extending away from the base surface, wherein a third exposed free end surface of the third projection includes a third pair of intersecting sipes extending inward into the third body; and wherein the outsole component further includes a fourth hole defined therein, wherein the third projection extends into the fourth hole.

Clause 61. The sole structure according to Clause 60, wherein the bottom surface of the midsole component further includes a fourth projection including a fourth body extending away from the base surface, wherein a fourth exposed free end surface of the fourth projection includes a fourth pair of intersecting sipes extending inward into the fourth body; and wherein the outsole component further includes a fifth hole defined therein, wherein the fourth projection extends into the fifth hole.

Clause 62. The sole structure according to Clause 61, wherein the bottom surface of the midsole component further includes a fifth projection including a fifth body extending away from the base surface, wherein a fifth exposed free end surface of the fifth projection includes a fifth pair of intersecting sipes extending inward into the fifth body; and wherein the outsole component further includes a sixth hole defined therein, wherein the fifth projection extends into the sixth hole.

Clause 63. The sole structure according to Clause 62, wherein the bottom surface of the midsole component further includes a sixth projection including a sixth body extending away from the base surface, wherein a sixth exposed free end surface of the sixth projection includes a sixth pair of intersecting sipes extending inward into the sixth body; and wherein the outsole component further includes a seventh hole defined therein, wherein the sixth projection extends into the seventh hole.

Clause 64. The sole structure according to Clause 63, wherein: (a) the first projection and the second hole are located at a lateral forefoot region of the sole structure, (b) the second projection and the third hole are located at a medial forefoot region of the sole structure, (c) the third projection and the fourth hole are located at the lateral forefoot region and/or a lateral midfoot region of the sole structure rearward of the first projection and the second hole, (d) the fourth projection and the fifth hole are located at the medial forefoot region and/or a medial midfoot region of the sole structure rearward of the second projection and the third hole, (e) the fifth projection and the sixth hole are located at a lateral heel region of the sole structure, and (f) the sixth projection and the seventh hole are located at a medial heel region of the sole structure.

Clause 65. The sole structure according to Clause 57, wherein the lateral side region of the bottom surface of the midsole component further includes a lateral side ridge extending away from the base surface, wherein a lateral side portion of the midsole component outside the lateral side ridge defines at least a portion of a lateral side bottom perimeter surface of the sole structure, wherein the medial side region of the bottom surface of the midsole component further includes a medial side ridge extending away from the base surface, wherein a medial side portion of the midsole component outside the medial side ridge defines at least a portion of a medial side bottom perimeter surface of the sole structure, wherein the central arch recess is located between the lateral side ridge and the medial side ridge, wherein at least a portion of an outermost exterior lateral edge of the outsole component is located inside the lateral side ridge, and wherein at least a portion of an outermost exterior medial edge of the outsole component is located inside the medial side ridge.

Clause 66. The sole structure according to Clause 57 or 65, wherein the bottom surface of the midsole component further includes a second hole located adjacent the central arch recess and extending inward from the base surface, wherein the second hole defines a transverse cross sectional area of less than 200 $mm^2$, and wherein the outsole component further includes a second protrusion extending from the interior surface and into the second hole of the midsole component.

Clause 67. The sole structure according to Clause 66, wherein the first hole is located in the lateral side region and the second hole is located in the medial side region.

Clause 68. The sole structure according to Clause 66, wherein the first hole is located in the lateral side region and the second hole is located in the lateral side region.

Clause 69. The sole structure according to Clause 66, wherein the first hole is located in the medial side region and the second hole is located in the medial side region.

Clause 70. The sole structure according to Clause 66, wherein the bottom surface of the midsole component further includes a third hole located adjacent the central arch recess and extending inward from the base surface, wherein the third hole defines a transverse cross sectional area of less than 200 $mm^2$, and wherein the outsole component further includes a third protrusion extending from the interior surface and into the third hole of the midsole component.

Clause 71. The sole structure according to Clause 70, wherein the bottom surface of the midsole component further includes a fourth hole located adjacent the central arch recess and extending inward from the base surface, wherein the fourth hole defines a transverse cross sectional area of less than 200 $mm^2$, and wherein the outsole component further includes a fourth protrusion extending from the interior surface and into the fourth hole of the midsole component.

Clause 72. The sole structure according to Clause 71, wherein each of the first hole and the second hole are located in the lateral side region and each of the third hole and the fourth hole are located in the medial side region.

Clause 73. The sole structure according to any one of Clauses 57 to 72, wherein the central arch recess includes a pair of intersecting sipes extending inwardly into an exposed exterior surface of the central arch recess.

Clause 74. An article of footwear, comprising: (a) an upper; and (b) a sole structure according to any preceding Clause engaged with the upper.

Clause 75. The article of footwear according to Clause 74, wherein the sole structure is engaged with the upper in a releasable manner.

Clause 76. The article of footwear according to Clause 74, wherein the sole structure is engaged with the upper by one or more hook-and-loop fasteners.

Clause 77. The article of footwear according to Clause 74, wherein the sole structure is engaged with the upper by stitching.

Clause 78. The article of footwear according to Clause 74, wherein the sole structure is engaged with the upper solely by one or more hook-and-loop fasteners.

Clause 79. The article of footwear according to Clause 74, wherein the sole structure is engaged with the upper solely by stitching.

What is claimed is:

1. A sole structure for an article of footwear, comprising:

a midsole component having a bottom surface, wherein the bottom surface includes: (i) a bottom base surface, (ii) a first projection including a first body extending away from the bottom base surface, wherein a first exposed free end surface of the first projection includes a first pair of intersecting sipes extending inward into the first body, (iii) a lateral side ridge extending downwardly from the bottom base surface, and (iv) a medial side ridge extending downwardly from the bottom base surface; and an outsole component removably engaged with the bottom surface of the midsole component, wherein the outsole component includes a first hole defined therein, wherein the first projection extends into the first hole, wherein the first exposed free end surface of the first projection is exposed through the first hole and recessed inward from an exposed exterior surface of the outsole component immediately adjacent the first hole, wherein the outsole component further includes an outermost exterior lateral edge and an outermost exterior medial edge, and wherein at least portions of the outermost exterior lateral edge and the outermost exterior medial edge of the outsole component are received between the lateral side ridge and the medial side ridge of the midsole component at the bottom surface of the midsole component.

2. The sole structure according to claim 1, wherein the bottom surface of the midsole component further includes: (i) a second projection including a second body extending away from the bottom base surface, wherein a second exposed free end surface of the second projection includes a second pair of intersecting sipes extending inward into the second body; and wherein the outsole component further includes a second hole defined therein, wherein the second projection extends into the second hole, and wherein the second exposed free end surface of the second projection is exposed through the second hole and recessed inward from the exposed exterior surface of the outsole component immediately adjacent the second hole.

3. The sole structure according to claim 2, wherein the first projection and the first hole are located in a forefoot region of the sole structure and the second projection and the second hole are located in a heel region of the sole structure.

4. The sole structure according to claim 2, wherein the first projection and the first hole are located in a forefoot region of the sole structure and the second projection and the second hole are located in the forefoot region of the sole structure.

5. The sole structure according to claim 2, wherein the first projection and the first hole are located in a heel region of the sole structure and the second projection and the second hole are located in the heel region of the sole structure.

6. The sole structure according to claim 2, wherein the first projection and the first hole are located forward of the second projection and the second hole in the sole structure.

7. The sole structure according to claim 2, wherein the first projection and the first hole are located on a lateral side of the sole structure and the second projection and the second hole are located on a medial side of the sole structure.

8. The sole structure according to claim 2, wherein each of the first projection, the first hole, the second projection, and the second hole are located on one of a lateral side or a medial side of the sole structure.

9. The sole structure according to claim 2, wherein the bottom surface of the midsole component further includes a third projection including a third body extending away from the bottom base surface, wherein a third exposed free end surface of the third projection includes a third pair of intersecting sipes extending inward into the third body; and wherein the outsole component further includes a third hole defined therein, wherein the third projection extends into the third hole, and wherein the third exposed free end surface of the third projection is exposed through the third hole and recessed inward from the exposed exterior surface of the outsole component immediately adjacent the third hole.

10. The sole structure according to claim 9, wherein the bottom surface of the midsole component further includes: (i) a fourth projection including a fourth body extending away from the bottom base surface, wherein a fourth exposed free end surface of the fourth projection includes a fourth pair of intersecting sipes extending inward into the fourth body; and wherein the outsole component further includes a fourth hole defined therein, wherein the fourth projection extends into the fourth hole, and wherein the fourth exposed free end surface of the fourth projection is exposed through the fourth hole and recessed inward from the exposed exterior surface of the outsole component immediately adjacent the fourth hole.

11. The sole structure according to claim 10, wherein the bottom surface of the midsole component further includes a fifth projection including a fifth body extending away from the bottom base surface, wherein a fifth exposed free end surface of the fifth projection includes a fifth pair of intersecting sipes extending inward into the fifth body; and wherein the outsole component further includes a fifth hole defined therein, wherein the fifth projection extends into the fifth hole, and wherein the fifth exposed free end surface of the fifth projection is exposed through the fifth hole and recessed inward from the exposed exterior surface of the outsole component immediately adjacent the fifth hole.

12. The sole structure according to claim 11, wherein the bottom surface of the midsole component further includes a sixth projection including a sixth body extending away from the bottom base surface, wherein a sixth exposed free end surface of the sixth projection includes a sixth pair of intersecting sipes extending inward into the sixth body; and wherein the outsole component further includes a sixth hole defined therein, wherein the sixth projection extends into the sixth hole, and wherein the sixth exposed free end surface of the sixth projection is exposed through the sixth hole and recessed inward from the exposed exterior surface of the outsole component immediately adjacent the sixth hole.

13. The sole structure according to claim 12, wherein: (a) the first projection and the first hole are located at a lateral forefoot region of the sole structure, (b) the second projection and the second hole are located at a medial forefoot region of the sole structure, (c) the third projection and the third hole are located at the lateral forefoot region and/or a lateral midfoot region of the sole structure rearward of the first projection and the first hole, (d) the fourth projection and the fourth hole are located at the medial forefoot region and/or a medial midfoot region of the sole structure rearward of the second projection and the second hole, (e) the fifth projection and the fifth hole are located at a lateral heel region of the sole structure, and (f) the sixth projection and the sixth hole are located at a medial heel region of the sole structure.

14. The sole structure according to claim 1, wherein a lateral side portion of the midsole component outside the lateral side ridge defines at least a portion of a lateral side bottom perimeter surface of the sole structure, and wherein a medial side portion of the midsole component outside the medial side ridge defines at least a portion of a medial side bottom perimeter surface of the sole structure.

15. The sole structure according to claim 1, wherein the bottom surface of the midsole component further includes: (i) a first protrusion extending outward from the bottom base surface, wherein the first protrusion has a transverse cross sectional area of less than 200 $mm^2$, and (ii) a second hole extending inward from the bottom base surface, wherein the second hole defines a transverse cross sectional area of less than 200 $mm^2$; and wherein the outsole component further includes: (i) an interior surface, (ii) a second protrusion extending from the interior surface and into the second hole of the midsole component, and (iii) a third hole defined in the interior surface and receiving the first protrusion of the midsole component.

16. The sole structure according to claim 1, wherein the bottom surface of the midsole component further includes:

(i) a second hole extending inward from the bottom base surface, wherein the second hole defines a transverse cross sectional area of less than 200 $mm^2$, and (iii) a third hole extending inward from the bottom base surface, wherein the third hole defines a transverse cross sectional area of less than 200 $mm^2$; and wherein the outsole component further includes: (i) an interior surface, (ii) a first protrusion extending from the interior surface and into the second hole of the midsole component, and (iii) a second protrusion extending from the interior surface and into the third hole of the midsole component.

17. The sole structure according to claim 1, wherein the bottom surface of the midsole component further includes: (i) a first protrusion extending outward from the bottom base surface, wherein the first protrusion has a transverse cross sectional area of less than 200 $mm^2$, (ii) a second protrusion extending outward from the bottom base surface, wherein the second protrusion has a transverse cross sectional area of less than 200 $mm^2$, (iii) a second hole extending inward from the bottom base surface, wherein the second hole defines a transverse cross sectional area of less than 200 $mm^2$, and (v) a third hole extending inward from the bottom base surface, wherein the third hole defines a transverse cross sectional area of less than 200 $mm^2$; and wherein the outsole component further includes: (i) an interior surface, (ii) a third protrusion extending from the interior surface and into the second hole of the midsole component, (iii) a fourth protrusion extending from the interior surface and into the third hole of the midsole component, (iv) a fourth hole defined in the interior surface and receiving the first protrusion of the midsole component, and (v) a fifth hole defined in the interior surface and receiving the second protrusion of the midsole component.

18. The sole structure according to claim 1, wherein the bottom base surface of the midsole component includes a lateral side region and a medial side region, wherein the bottom surface of the midsole component further includes: (i) a central arch recess extending inward from the bottom base surface and located between the lateral side region and the medial side region, and (ii) a first hole located adjacent the central arch recess and extending inward from the bottom base surface at one of the lateral side region or the medial side region, wherein the first hole defines a third transverse cross sectional area of less than 200 $mm^2$; and wherein the outsole component further includes: (i) an interior surface, (ii) a first opening through which the central arch recess is exposed at a bottom of the sole structure, and (iii) a first protrusion extending from the interior surface and into the first hole of the midsole component.

19. The sole structure according to claim 1, wherein the bottom base surface of the midsole component includes a lateral side region and a medial side region, wherein the bottom surface of the midsole component further includes a central arch recess extending inward from the bottom base surface and located between the lateral side region and the medial side region, and wherein the outsole component further includes a first opening through which the central arch recess is exposed at a bottom of the sole structure.

20. The sole structure according to claim 1, wherein each sipe of the first pair of intersecting sipes extends inward into the first body to a sipe depth that is at least 20% of an overall height dimension of the first projection.

21. The sole structure according to claim 1, wherein each sipe of the first pair of intersecting sipes extends inward into the first body to a sipe depth that is at least 40% of an overall height dimension of the first projection.

22. An article of footwear, comprising:

an upper; and a sole structure engaged with the upper, the sole structure including:

(i) a midsole component having a bottom surface, wherein the bottom surface includes: (a) a bottom base surface, (b) a first projection including a first body extending away from the bottom base surface, wherein a first exposed free end surface of the first projection includes a first pair of intersecting sipes extending inward into the first body, (c) a lateral side ridge extending downwardly from the bottom base surface, and (d) a medial side ridge extending downwardly from the bottom base surface; and (ii) an outsole component removably engaged with the bottom surface of the midsole component, wherein the outsole component includes a first hole defined therein, wherein the first projection extends into the first hole, wherein the first exposed free end surface of the first projection is exposed through the first hole and recessed inward from an exposed exterior surface of the outsole component immediately adjacent the first hole, wherein the outsole component further includes an outermost exterior lateral edge and an outermost exterior medial edge, and wherein at least portions of the outermost exterior lateral edge and the outermost exterior medial edge of the outsole component are received between the lateral side ridge and the medial side ridge of the midsole component at the bottom surface of the midsole component.

* * * * *